US008348398B2

(12) United States Patent
Yokota

(10) Patent No.: US 8,348,398 B2
(45) Date of Patent: Jan. 8, 2013

(54) DROPLET EJECTION DEVICE AND METHOD FOR COLLECTING ADHERENT LIQUID

(75) Inventor: Yasuyo Yokota, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 459 days.

(21) Appl. No.: 12/725,363

(22) Filed: Mar. 16, 2010

(65) Prior Publication Data

US 2010/0245496 A1 Sep. 30, 2010

(30) Foreign Application Priority Data

Mar. 31, 2009 (JP) ..... 2009085271

(51) Int. Cl.
*B41J 2/175* (2006.01)

(52) U.S. Cl. ..... 347/85

(58) Field of Classification Search ..... 347/85, 347/84, 86, 87, 89, 93
See application file for complete search history.

(56) References Cited

U.S. PATENT DOCUMENTS

| | | | | |
|---|---|---|---|---|
| 7,837,314 | B2 * | 11/2010 | Kyoso | 347/85 |
| 8,100,517 | B2 * | 1/2012 | Karppinen et al. | 347/85 |
| 2008/0246804 | A1 | 10/2008 | Kawase et al. | |
| 2010/0231622 | A1 * | 9/2010 | Sasaki et al. | 347/85 |

FOREIGN PATENT DOCUMENTS

| | | | |
|---|---|---|---|
| JP | 2003-127436 | A | 5/2003 |
| JP | 2008-254279 | A | 10/2008 |

* cited by examiner

*Primary Examiner* — Kristal Feggins
(74) *Attorney, Agent, or Firm* — Fish & Richardson P.C.

(57) ABSTRACT

There is provided a droplet ejection device comprising: a droplet ejecting head comprising a droplet ejecting surface on which an ejecting aperture from which droplets are ejected and a collecting hole for collecting adherent liquid adhered to the droplet ejecting face are formed; and a collecting unit that causes the liquid to overflow to the droplet ejecting face through the collecting hole and collects the overflowed liquid through the collecting hole together with the adherent liquid.

14 Claims, 16 Drawing Sheets

DROPLET EJECTION DEVICE AND METHOD FOR COLLECTING ADHERENT LIQUID

CROSS-REFERENCE TO RELATED APPLICATION

This application claims priority under 35 USC 119 from Japanese Patent Application No. 2009-085271 filed on Mar. 31, 2009, the disclosure of which is incorporated by reference herein.

BACKGROUND OF THE INVENTION

1. Field of the Invention

The present invention relates to a droplet ejection device and a method for collecting adherent liquid, and more particularly to a droplet ejection device and method for collecting adherent liquid for collecting adherent liquid adhered to a droplet ejecting face.

2. Description of the Related Art

A droplet ejection device includes, for example, an inkjet recording device that ejects droplets of ink or the like from nozzles of a recording head to record an image on a recording medium such as paper or the like. In the inkjet recording device, during ink droplet ejections, ink mist or ink leaking from the nozzles or the like may adhere on an ink droplet ejecting face near the nozzles, and the ejection directions of ink droplets may be diverted or ink droplet ejection itself may be hindered.

Therefore, as a method for removing ink adhering to the ejection face, it has been considered to wipe the ejection face. However, in order to perform wiping operation, recording operation recording an image with ink droplets must be temporarily stopped, and printing speed is reduced. As a method for collecting adherent ink adhered to the ejection face without interrupting recording operation, it has been proposed in Japanese Patent Application Laid-Open (JP-A) No. 2008-254279 to form a collecting hole in the ejection face and collect adherent liquid adhered to the ejection face through this collecting hole.

In the liquid ejection head of JP-A No. 2008-254279, the collecting hole is in communication with an ink chamber, and adherent ink collected through the recovery hole is collected into the chamber. In addition, to guide the adherent ink into the collecting hole, on a nozzle plate face (the ejection face), a non-water-repellent region is formed around the collecting hole, and a water-repellent region is formed around the non-water-repellent region.

However, adherent ink adhered to the face of the nozzle plate becomes viscous due to drying, or solidified particles, dust in the atmosphere or the like may be mingled with the adherent ink. Therefore, as in the liquid head ejection head of JP-A No. 2008-254279, if liquid that is collected is re-used, clogging of nozzles or the like may occur.

On the other hand, JP-A No. 2003-127436 discloses an inkjet recording device in which an ink collection aperture is provided in the vicinity of nozzles in an orifice plate face and an ink intake unit is provided at the ink recovery aperture via a collection path. In the above inkjet recording device, the orifice plate face is wiped and adherent ink is scraped off, and when the scraped off ink reaches the ink collection aperture, the ink is taken into the ink intake unit. In addition, a vicinity of the ink recovery aperture is given better wetting characteristics than the vicinity of the nozzles.

However, in spite of forming a non-water-repellent region around the collecting hole or improving wettability of the ink collection aperture vicinity as disclosed in JP-A Nos. 2008-254279 and 2003-127436, adherent liquid at the non-water-repellent region or region with good wetting may not be thoroughly collected. Ink not being collected hardens and, for example, solid matter scraped off by a wiping member (wiper) in a wiping operation may clog up the nozzles.

SUMMARY OF THE INVENTION

The present invention has been made in view of the above circumstances, and an object is to provide a droplet ejection device and method for collecting adherent liquid that enables collecting adherent liquid adhered to a droplet ejecting face without interrupting droplet ejection operations.

The present invention has been made in view of the above circumstances and provides a droplet ejection device and a method for collecting adherent liquid.

A first aspect is a droplet ejection device including: a droplet ejecting head comprising a droplet ejecting surface on which an ejecting aperture from which droplets are ejected and a collecting hole for collecting adherent liquid adhered to the droplet ejecting face are formed; and a collecting unit that causes the liquid to overflow to the droplet ejecting face through the collecting hole and collects the overflowed liquid through the collecting hole together with the adherent liquid.

A second aspect is a method for collecting adherent liquid adhered to a droplet ejecting face of a droplet ejecting head, the method including: forming a collecting hole for collecting adherent liquid adhered to the droplet ejecting surface of a droplet ejecting head; overflowing liquid from the collecting hole onto the droplet ejecting face; and collecting the overflowed liquid together with the adherent liquid adhered on the droplet ejecting surface.

DETAILED DESCRIPTION OF THE INVENTION

Hereinafter, exemplary embodiments of the present invention are described in detail with reference to the attached drawings. In the following exemplary embodiments, examples in which the present invention is applied to an inkjet recording device ejecting ink droplets to record an image at a recording medium are described.

--Inkjet Recording Device--

Figure 1:
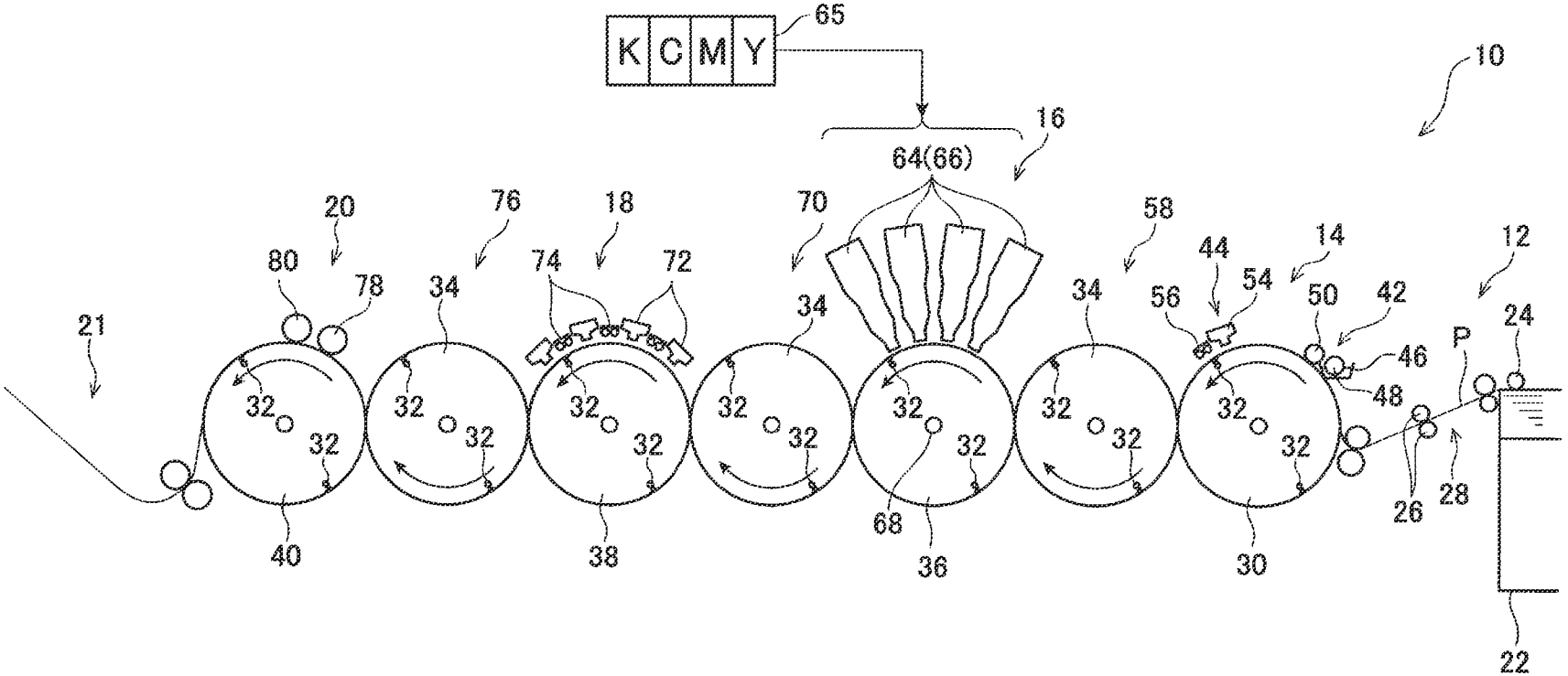
FIG. 1 is a sectional side view illustrating general constitution of an inkjet recording device of a first exemplary embodiment.

FIG. 1 shows an overall structural diagram of an inkjet recording device 10.

As illustrated in FIG. 1, the inkjet recording device 10 is provided with a paper supply conveyance section 12 that supplies and conveys sheet paper P (hereinafter referred to "paper P") which serves as a recording medium, at an upstream side of a conveyance direction of the paper P (hereinafter referred to "the upstream side"). Along the conveyance direction of the paper P to the downstream side from the paper supply conveyance section 12, a processing liquid application section 14, an image recording section 16, an ink drying section 18, an image fixing section 20 and an discharging section 21 are provided. The processing liquid application section 14 applies a processing liquid to a recording face of the paper P. The image recording section 16 records an image on the recording face of the paper P. The ink drying section 18 dries the image recorded on the recording face. The image fixing section 20 fixes the dried image to the paper P. The paper P on which the image has been fixed is discharged from the discharging section 21. The respective sections are described hereinafter.

-Paper Supply Conveyance Section-

A stacking section 22 at which the paper P is stacked is provided at the paper supply conveyance section 12. A paper supply section 24 that supplies the paper P stacked in the stacking section 22, one sheet at a time, is provided above the stacking section 22. A conveyance section 28, which is structured to include plural pairs of rollers 26, is provided at downstream of the paper supply section 24 with respect to the paper P conveyance direction (hereinafter, the term "paper P conveyance direction" may be omitted). The paper P supplied by the paper supply section 24 is conveyed to the processing liquid application section 14 through the conveyance section 28 that is structured with plural pairs of rollers 26.

-Processing Liquid Application Section-

At the processing liquid application section 14, a processing liquid application drum 30 is rotatably provided. A retention member 32 is provided on the processing liquid application drum 30. The retention member 32 nips a leading end portion of the paper P and retains the paper P. In a state in which the paper P is retained at a surface of the processing liquid application drum 30 by means of the retention member 32, the paper P is conveyed downstream by rotation of the processing liquid application drum 30.

As on the processing liquid application drum 30, retention members 32 are also provided on an intermediate conveyance drum 34, an image forming drum 36, an ink drying drum 38 and an image fixing drum 40, which are described below. The paper P is passed along from upstream side drums to downstream side drums by these retention members 32.

At an upper portion of the processing liquid application drum 30, a processing liquid application device 42 and a processing liquid drying device 44 are arranged along the circumferential direction of the processing liquid application drum 30. The processing liquid is applied to the recording face of the paper P by the processing liquid application device 42, and this processing liquid is dried by the processing liquid drying device 44.

Here, the processing liquid has the effect of reacting with the ink and aggregating a colorant (pigment), and promoting separation of the colorant from a solvent. A reservoir section 46, which stores the processing liquid, is provided at the processing liquid application device 42, and a portion of a gravure roller 48 is immersed in the processing liquid.

A rubber roller 50 is disposed to press against the gravure roller 48. The rubber roller 50 touches against the recording side of the paper P and applies the processing liquid thereto. A squeegee (not shown in the figures) also touches against the gravure roller 48 and controls processing liquid application amounts that are applied to the recording face of the paper P.

Ideally, a processing liquid layer thickness is significantly smaller than droplets that is to be ejected from the head. For example, if the droplet amount is 2 pl, the average diameter of the droplets ejected from the head is 15.6 μm. If the processing liquid film thickness is too thick, the ink dots will float in the processing liquid and not make contact with the recording face of the paper. To obtain impact dot diameters of 30 μm or above from droplets having an amount of 2 pl, the processing liquid layer thickness is preferably 3 μm or less.

Meanwhile, at the processing liquid drying device 44, a hot air nozzle 54 and an infrared heater 56 (hereinafter referred to the "IR heater 56") are disposed close to the surface of the processing liquid application drum 30. A solvent such as water or the like in the processing liquid is evaporated by the hot air nozzle 54 and IR heater 56, and a solid or thin-film processing liquid layer is formed at the recording side of the paper. The processing liquid is formed into a thin layer by the processing liquid drying process. Hence, at the image recording section 16, ink droplets that are impacted come into contact with the paper surface and provide a required dot diameter, and an action of the droplets reacting with the thin film of processing liquid so as to coagulate the colorant and solidify themselves on the paper surface.

Hence, the paper P of which recording face the processing liquid has been applied to and dried by the processing liquid application section 14 is conveyed to an intermediate conveyance section 58 provided between the processing liquid application section 14 and the image recording section 16.

-Intermediate Conveyance Section-

At the intermediate conveyance section 58, the intermediate conveyance drum 34 is rotatably provided, the paper P is retained at the surface of the intermediate conveyance drum 34 by means of the retention member 32 that is provided on the intermediate conveyance drum 34, and the paper P is conveyed to the downstream side by rotation of the intermediate conveyance drum 34.

-Image Formation Section-

At the image recording section 16, the image forming drum 36 is rotatably provided, the paper P is retained at the surface of the image forming drum 36 by means of the retention member 32 that is provided at the image forming drum 36, and the paper P is conveyed to the downstream side by rotation of the image forming drum 36.

At an upper portion of the image forming drum 36, head units 66 are disposed close to the surface of the image forming drum 36. The head units 66 are structured with single pass-type inkjet line heads 64 (hereinafter referred simply to "heads"). In the head units 66, at least heads 64 of the colors YMCK being basic colors are arrayed along the circumferential direction of the image forming drum 36. Images of the respective colors are recorded on the processing liquid layer that has been formed at the recording face of the paper by the processing liquid application section 14.

The processing liquid exhibits an effect of aggregating colorant (pigment) and latex particles dispersed in the ink with the processing liquid so as to form aggregate bodies with which colorant running on the paper P or the like does not occur. For example, an acid can be incorporated in the processing liquid so as to lower the pH of the droplets, disrupt pigment dispersion, and coagulate the pigment when contacting with the droplets. Accordingly, exudation of colorants, color mixing between inks of the respective colors and jet droplet interference due to liquid mixing when the ink droplets impact can be prevented.

At each head 64, by jetting the droplets synchronously with an encoder (not shown) that that is provided at the image forming drum 36 so as to detect rotation speed thereof, impact positions can be set with a high accuracy as well as impact droplet irregularities can be reduced regardless of vibrations of the image forming drum 36, deflection of the rotating axis of a rotation axle 68 and deviation of the drum surface speed of the image forming drum 36.

Herein, the head units 66 are disposed so as to be movable away from the upper portion of the image forming drum 36. Maintenance operations, such as nozzle face cleaning of the heads 64, removal of viscous ink or the like, are implemented by moving the head units 66 away from the upper portion of the image forming drum 36.

The inkjet recording device 10 is provided with an ink circulation system 65 for each of the YMCK heads 64. Each of the ink circulation systems 65 includes an ink supply section 160 storing ink of color corresponding to each of the YMCK heads 64. The ink supply sections 160 are in communication with the YMCK heads 64 via predetermined piping (which will be described in more detail later).

The paper P on whose recording face the image has been recorded at the image recording section 16 is conveyed by rotation of the image forming drum 36 to an intermediate conveyance section 70 provided between the image recording section 16 and the ink drying section 18. The intermediate conveyance section 70 has a constitution substantially the same as the intermediate conveyance section 58, and thus, the constitution thereof is not described.

-Ink Drying Section-

The ink drying drum 38 is rotatably provided at the ink drying section 18. At an upper portion of the ink drying drum 38, a plurality of hot air nozzles 72 and IR heaters 74 are disposed close to the surface of the ink drying drum 38.

Here, as an example, the hot air nozzles 72 are disposed at an upstream side and at a downstream side, and a pair of the IR heaters 74 are arranged alternatingly and in parallel with the hot air nozzles 72 between the upstream most and downstream most hot air nozzles 72. Alternatively, the IR heaters 74 may be disposed at the upstream and the hot air nozzles 72 may be disposed to the downstream side so that heat energy from the IR heaters 74 is greatly irradiated at the upstream side so as to raise a temperature of moisture in the paper P and to turn the moisture to blow away as saturated water vapor at the downstream side.

In the present exemplary embodiment, the hot air nozzles 72 are disposed so that the hot air blowing direction from the hot air nozzles 72 is tilted with respect to the trailing end of the paper P. Accordingly, the flow of hot wind from the hot air nozzles 72 may be concentrated in one direction. Moreover, the paper P may be pushed against the ink drying drum 38 and the state of retention of the paper on the surface of the ink drying drum 38 can be maintained.

Solvent on the paper P that has been separated by the colorant aggregation action at a region at which the image has been recorded is dried by the hot wind from the hot air nozzles 72 and the IR heaters 74, and a thin-film image layer is formed.

Though varying in accordance with the conveyance speed of the paper P, the temperature of the hot air will ordinarily be set from 50° C. to 70° C. An ink surface temperature is set to be at 50° C. to 60° C. by setting a temperature of the IR heaters 74 to 200° C. to 600° C. The evaporated solvent is evacuated out of the inkjet recording device 10 together with air, and the air is recovered. This air may be cooled by a cooling device, or a radiator or the like and the evaporated solvent may be collected as a liquid.

The paper P at whose recording face the image has been dried is conveyed by rotation of the ink drying drum 38 to an intermediate conveyance section 76 provided between the ink drying section 18 and the image fixing section 20. The intermediate conveyance section 76 has a constitution substantially the same as the intermediate conveyance section 58, and accordingly the constitution thereof is not described.

-Image Fixing Section-

The image fixing drum 40 is rotatably provided in the image fixing section 20. In the image fixing section 20, the latex particles in the thin image layer that was formed on the ink drying drum 38 are heated and pressured, and fused, and the image fixing section 20 has a function of solid-fixing onto the paper.

At an upper portion of the image fixing drum 40, a heating roller 78 is disposed close to the surface of the image fixing drum 40. The heating roller 78 comprises a halogen lamp and a metal tube formed of a metal having a good thermal conductivity, e.g., aluminium or the like, inside which the halogen lamp is incorporated. Heat energy to at least the glass transition temperature Tg of the latex is supplied by the heating roller 78. As a result, the latex particles fuse, and are pressed into irregularities on the paper and fixed. In addition, irregularities in the recording face may be leveled and glossiness is provided.

A fixing roller 80 is provided downstream of the heating roller 78. The fixing roller 80 is disposed in a state of abutting against the surface of the image fixing drum 40, so as to provide nipping force between the fixing roller 80 and the image fixing drum 40. Accordingly, at least one of the fixing roller 80 and the image fixing drum 40 has a resilient layer at the surface thereof and is constituted so as to provide a uniform nipping width with regard to the paper P.

The paper P to whose recording face the image has been fixed by the steps described above is conveyed toward the discharging section 21 provided at the downstream side of the image fixing section 20, by rotation of the image fixing drum 40.

In the present exemplary embodiment, the image fixing section 20 has been described. However, it would be sufficient that the image formed on the recording face be dried and fixed by the ink drying section 18, and accordingly, the image fixing section 20 is not always indispensable for the inkjet recording device 10.

Next, structure of the head 64 is described. The head 64 is provided with a plurality of nozzles 202 (a row of ejecting apertures) for ejecting ink droplets in a single face 200 (hereinafter referred to "droplet ejecting face"). A pressure chamber 204 and a droplet ejection element are respectively provided at each nozzle 202. In the present exemplary embodiment, a liquid repellence film is formed over the whole of the droplet ejecting face 200 so as to facilitate collection of adherent ink that adheres thereto. In addition, the droplet ejecting face 200 is made flat.

Figure 2:
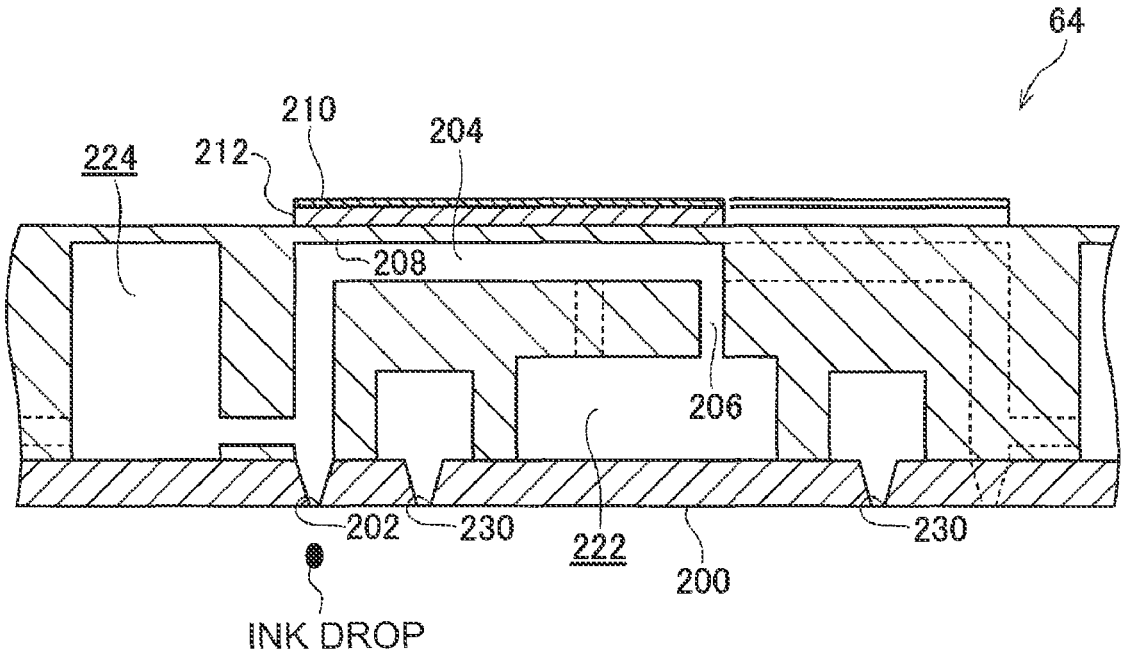
FIG. 2 is a sectional side view of a head of the first exemplary embodiment.

As illustrated in FIG. 2, the pressure chambers 204 for pressurizing the ink are in communication, via supply apertures 206, with a common supply flow path 222. The common supply flow path 222 is in communication with the ink supply section 160, which will be described later, and distributes and supplies ink supplied from the ink supply section 160 through the common supply flow path 222 to the pressure chambers 204.

An actuator 212, which is provided with an individual electrode 210, is joined to a pressure plate 208 (an oscillating plate that is also used as a common electrode) that constitutes a portion of a face of the each pressure chamber 204 (the upper face in FIG. 2). By application of a driving voltage between the individual electrode 210 and the common electrode, the actuator 212 is deformed and the volume of the pressure chamber 204 changes. In association therewith, ink is ejected from the nozzle 202 by a pressure change. As the actuator 212, a piezoelectric element formed of a material such as piezoelectric body such as lead zirconate titanate, barium titanate or the like can be preferably used. When the displacement of the actuator 212 returns to its original state after the ink ejection, new ink is recharged into the pressure chamber 204 through the supply aperture 206 from the common supply flow path 222.

Thus, in the inkjet recording device 10 relating to the present exemplary embodiment, ink droplets may be ejected from the nozzles 202 by controlling driving of the actuators 212 corresponding with the nozzles 202 in accordance with dot position data that is generated from image information. Further, in the inkjet recording device 10 relating to the present exemplary embodiment, while the paper P is being conveyed in a sub scanning direction at a certain speed, a desired image may be recorded on the paper P by controlling ink ejection timings of the nozzles 202 to match the conveyance speed.

Here, in the present exemplary embodiment, a system in which ink droplets are caused to fly out by deformation of the actuator 212 as represented by a piezo element (piezoelectric element) is employed. However, systems for ejecting ink are not particularly limited in relation to exemplary embodiments of the present invention. Various systems may be employed instead of a piezo-jet system, such as a thermal jet system, which heatsink with a heat-generating body such as a heater or the like, generates air bubbles and causes ink droplets to fly out by pressure thereof, or the like.

A common return flow path 224, which is in communication with each of the nozzles 202, is provided at the opposite side of the nozzle 202 from the common supply flow path 222. The common return flow path 224 is in communication, via an ink return channel 182, with an ink return section 162.

Figure 15:
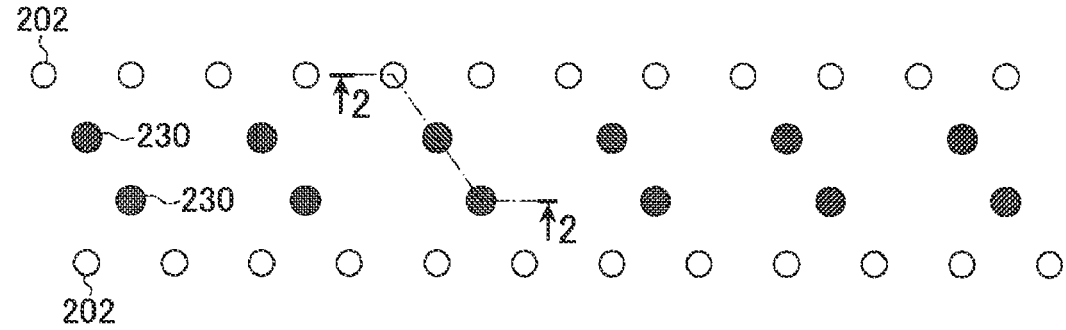
FIG. 15 is a plan view illustrating a variant example of the arrangement of the nozzles and the collecting holes at the head of the first exemplary embodiment.

Collecting holes 230 are formed adjacent to the nozzles 202 on the droplet ejecting face 200 of the head 64. A collecting flow path 256 that features flexibility (for example, a rubber tube or the like) is connected to one ends of the collecting holes 230. The collecting flow path 256 is connected to a collecting device 250, which will be described later. A pattern of arrangement of the nozzles 202 and the collecting holes 230 for the present exemplary embodiment is illustrated in FIG. 15; an arrangement pattern in which the nozzles 202 are arranged in two rows and the collecting holes 230 are arranged in two rows between the rows of the nozzles 202 is employed here. Patterns of arrangement of the nozzles 202 and the collecting holes 230 are described later. FIG. 2 shows a sectional view cut along line 2-2 of FIG. 15.

The ink circulation system 65 of the present exemplary embodiment is described with reference to FIG. 3. The ink circulation system 65 is provided in correspondence with each of the YMCK heads 64. However, each ink circulation system 65 has the same constitution, so a single ink circulation system 65 will be representatively described here.

Figure 3:
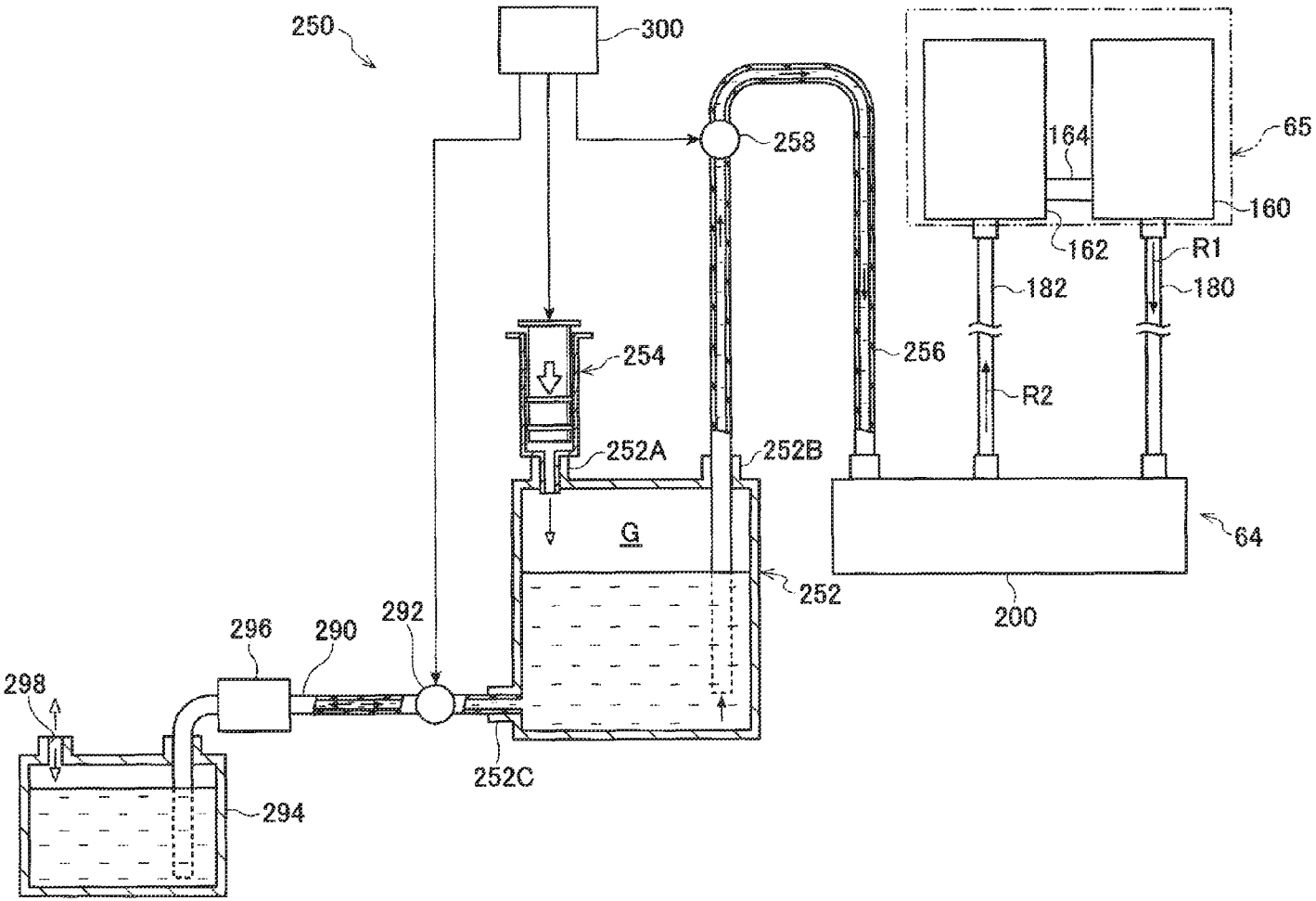
FIG. 3 is a schematic sectional side view illustrating a state in which liquid is supplied to a collecting hole by using a collecting device of the first exemplary embodiment.

As illustrated in FIG. 3, the ink circulation system 65 is provided with the ink supply section 160, which stores ink, and the ink return section 162, which temporarily stores ink collected from the head 64. The ink supply section 160 and the head 64 are connected via an ink supply channel 180. Ink is supplied through this supply channel 180 from the ink supply section 160 to the common supply flow path 222, which will be described later, in the head 64. The ink return section 162 and the head 64 are connected via the ink return channel 182. Ink is returned through the ink return channel 182 from the common return flow path 224, which will be described later, in the head 64 to the ink return section 162. Ink that has returned to the ink return section 162 (been recovered) is returned to the ink supply section 160 through a communication channel 164 that links the ink return section 162 with the ink supply section 160. Herein, an ink circulation path is constituted by the supply channel 180, the ink return channel 182, the communication channel 164, the common supply flow path 222 and the common return flow path 224. The ink circulation system 65 of the present exemplary embodiment includes the ink circulation path. The arrow R1 shown in FIG. 3 is the ink supply direction and the arrow R2 is the ink return direction. A circulation flow generation device (a pump or the like, which is not illustrated), which generates a circulation current for circulation of the ink, is provided on the ink circulation system 65.

-Collecting Device-

Although not illustrated in FIG. 1, the collecting device 250 is provided in a vicinity of the head 64. The collecting device 250 is a device that causes a liquid to overflow onto the droplet ejecting face 200 from the collecting holes 230 formed on the droplet ejecting face 200, and collects the overflowed liquid together with adherent ink that has adhered to the droplet ejecting face 200.

As illustrated in FIG. 3, the collecting device 250 is provided with a storage tank 252 that stores the liquid, a syringe pump 254 that causes pressure to act on the liquid stored in the storage tank 252, a control section 300 that controls the syringe pump 254, the aforementioned collecting holes 230, the collecting flow path 256 that connects the collecting holes 230 with the storage tank 252, and a valve 258 that is provided on the collecting flow path 256. The control section 300 and the syringe pump 254 are an example of a pressure increasing—decreasing unit of the present invention.

The storage tank 252 is provided with a first connection port 252A at one side of an upper portion of the storage tank 252, a second connection port 252B at another side of the upper portion, and a third connection port 252C at a lower portion of the storage tank 252. The syringe pump 254 is connected to the first connection port 252A, and the collecting flow path 256 is connected to the second connection port 252B. A liquid supply channel 290, which will be described later, is connected to the third connection port 252C. A valve 292, which is controlled by the control section 300, is provided on the liquid supply channel 290 between the storage tank 252 and a collection tank 294, which will be described later. The valve 292 is controlled by the control section 300 so as to open at a replacement operation time at which the liquid replacement is carried out, and close at a time except the replacement operation time. Here, because each connection port is connected with the syringe pump 254, the collecting flow path 256, or the liquid supply path 290, the storage tank 252 is in a substantially closed state.

As mentioned above, one end of the collecting flow path 256 is connected to the collecting holes 230 and the other end of the collecting flow path 256 is passed through the second connection port 252B and disposed inside the storage tank 252. The valve 258 controlled by the control section 300 is provided on this collecting flow path 256. The valve 258 is controlled by the control section 300 so as to open at a time of collecting operation and at a time of the replacement operation, and close at a time except the collecting operation time and the replacement operation time. "Collecting operation" herein is referred to a series of operations causing liquid to overflow from the collecting holes 230 through the collecting flow path 256 and collecting the overflowed liquid.

Figure 4:
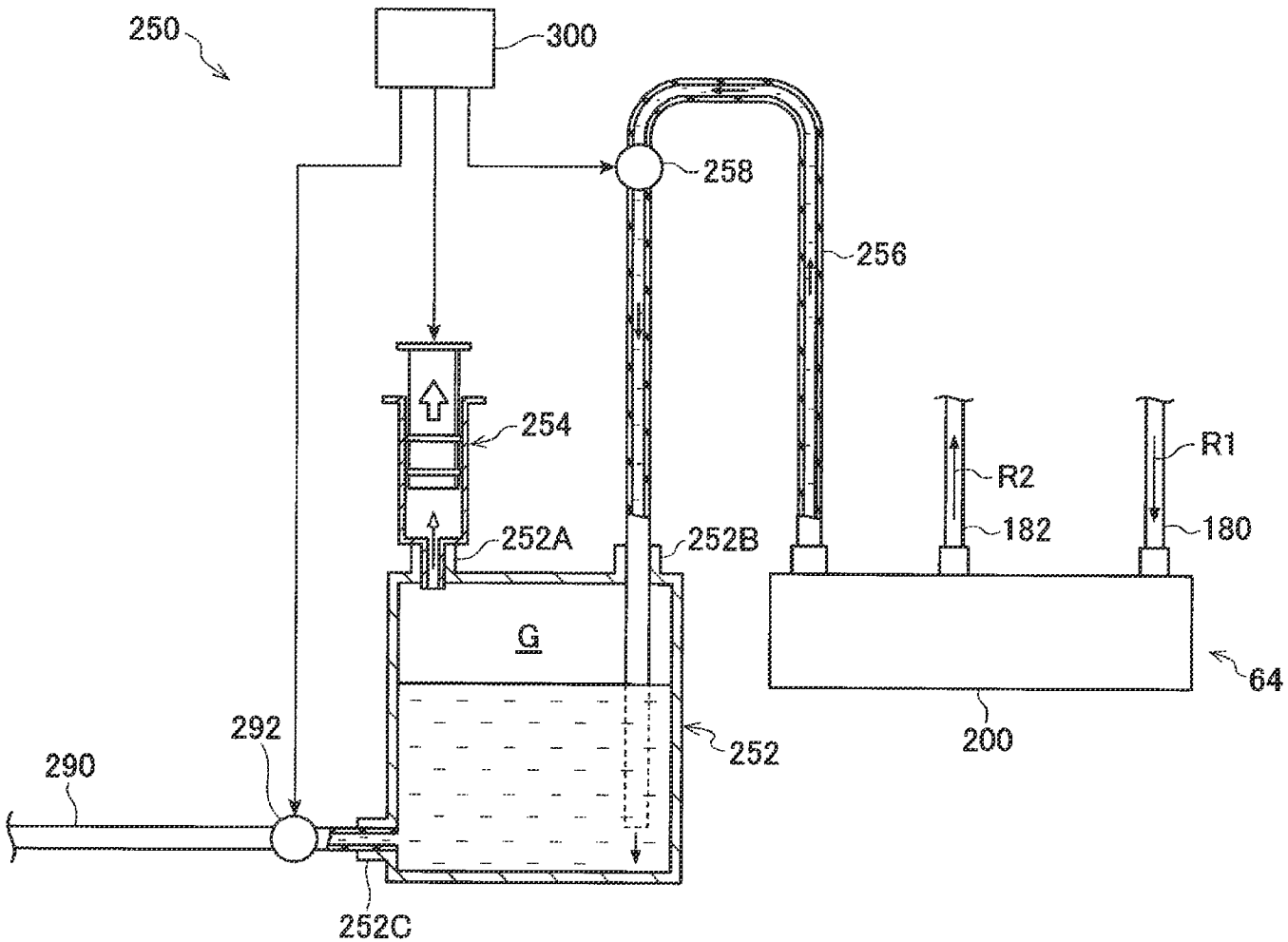
FIG. 4 is a schematic sectional side view illustrating a state in which liquid is collected through the collecting hole by using the collecting device of the first exemplary embodiment.

The syringe pump 254 is controlled by the control section 300 and may increase or decrease pressure of an air layer G that is formed at an upper portion of the storage tank 252. Specifically, by expanding or compressing an internal airspace of the syringe pump 254, pressure of the air layer G that is in communication with this internal airspace may be increased or decreased. If the internal airspace of the syringe pump 254 is reduced and the pressure of the air layer G is raised, as illustrated in FIG. 3, the surface of the liquid stored in the storage tank 252 is pressed by the air layer G whose pressure is being raised, and the pressed liquid overflows through the collecting flow path 256 and from the collecting holes 230 to the droplet ejecting face 200. If the internal airspace of the syringe pump 254 is expanded and the pressure of the air layer G is reduced, as illustrated in FIG. 4, the surface of the liquid stored in the storage tank 252 is drawn up by a negative pressure, and the liquid is collected through the collecting flow path 256 to the storage tank 252. At this time, the liquid that overflowed onto the droplet ejecting face 200 is collected through the collecting holes 230. Note that the black arrows in the drawings represent flows of ink and the white arrows represent flows of air.

The control section 300 controls the syringe pump 254 to control the pressure that is caused to act on the air layer G. The pressure acting on the air layer G is specified (to a predetermined value) as follows: when the liquid is caused to overflow at the droplet ejecting face 200, the liquid is overflowed in a predetermined amounts so that the overflowed liquid will not reach the nozzles 202 adjacent to the collecting holes 230, on the other hand, when the overflowed liquid is collected from the droplet ejecting face 200, a collection force (suction force) is specified such that the liquid on the droplet ejecting face 200 may be reliably collected. Because these predetermined values will vary in accordance with a design of the head 64, environments or the like, it is preferable to perform a number of tests beforehand so as to determine a preferable range of the pressure.

The control section 300 also controls the syringe pump 254 to alter the pressure acting on the air layer G from the predetermined values in accordance with a repetition number of the collecting operations or measured values from a sensor (not shown) that measures a degree of viscosity of the liquid.

It is preferable if the liquid stored in the storage tank 252 is a liquid in which the adherent ink adhered to the droplet ejecting face 200 is soluble or dispersible. In the present exemplary embodiment, a liquid capable of dissolving the adherent ink is used. Herein, the adherent ink may be used as the liquid. The color of the liquid is preferably the same color as the adherent liquid or transparent. It is preferable if the liquid that is used has a surface tension of not more than 40 mN/m and not less than 10 mN/m, and more preferable if the surface tension is not more than 35 mN/m and not less than 25 mN/m, such that the liquid does not drip off when overflowed from the collecting holes 230 or scatter during collecting to leave collection residue.

Next, operation of the inkjet recording device 10 relating to the present exemplary embodiment is described.

In the present exemplary embodiment, paper P is supplied from the stacking section 22 by the paper supply section 24, and is conveyed via the conveyance section 28 to the processing liquid application section 14. At the processing liquid application section 14, the processing liquid is applied to the recording face of the paper P, and the processing liquid is dried. Thereafter, the paper P is conveyed via the intermediate conveyance section 58 to the image recording section 16, and is retained at the surface of the image forming drum 36. Then, at the image recording section 16, ink droplets are ejected at the recording face of the paper P from the nozzles 202 of the heads 64 in accordance with image information. Thus, an image corresponding to the image information is recorded on the recording face of the paper P.

The paper P on whose recording face the image has been recorded in the image recording section 16 is conveyed via the intermediate conveyance section 70 to the ink drying section 18. At the ink drying section 18, the solvent in the ink on the recording face of the paper P is dried. Thereafter, the paper P is conveyed via the intermediate conveyance section 76 to the image fixing section 20. At the image fixing section 20, fixing processing for the image recorded on the recording face of the paper P is carried out. Then the paper P on whose recording face the image has been fixed is discharged to the discharging section 21 by rotation of the image fixing drum 40.

Figure 5A:
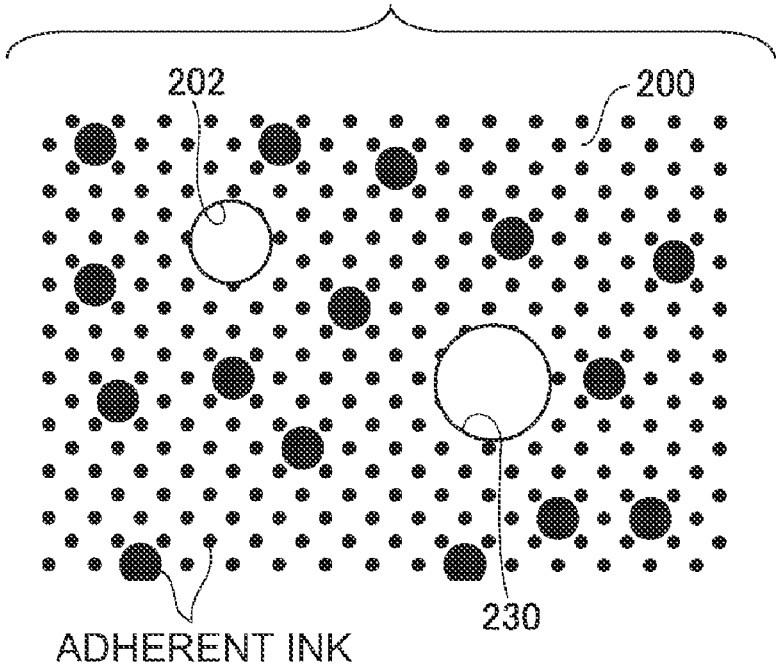
FIG. 5A is a plan view illustrating a state in which adherent ink is adhered to a droplet ejecting face of the head of the first exemplary embodiment.

When an image is recorded on a first sheet of paper P, ink mist or the like adhere to the droplet ejecting face 200 of each head 64 (the black spots in FIG. 5A are adherent ink). Accordingly, the inkjet recording device 10 of the present exemplary embodiment is set so as to implement the collecting operation before image recording is carried out on a second sheet of paper P. The present invention is not to be limited to carry out collecting operation thus; the collecting operation may be implemented at any time.

As illustrated in FIG. 3, the control section 300 sends signals to implement the collecting operation to the sections that it controls, before the inkjet recording device 10 finishes image recording onto the first sheet of paper P and carries out an image recording operation on the next (a second) paper P. The valve 258 receives a signal and opens, and the syringe pump 254 raises the pressure of the air layer G such that a predetermined amount of the liquid overflows onto the droplet ejecting face 200.

Figure 5B:
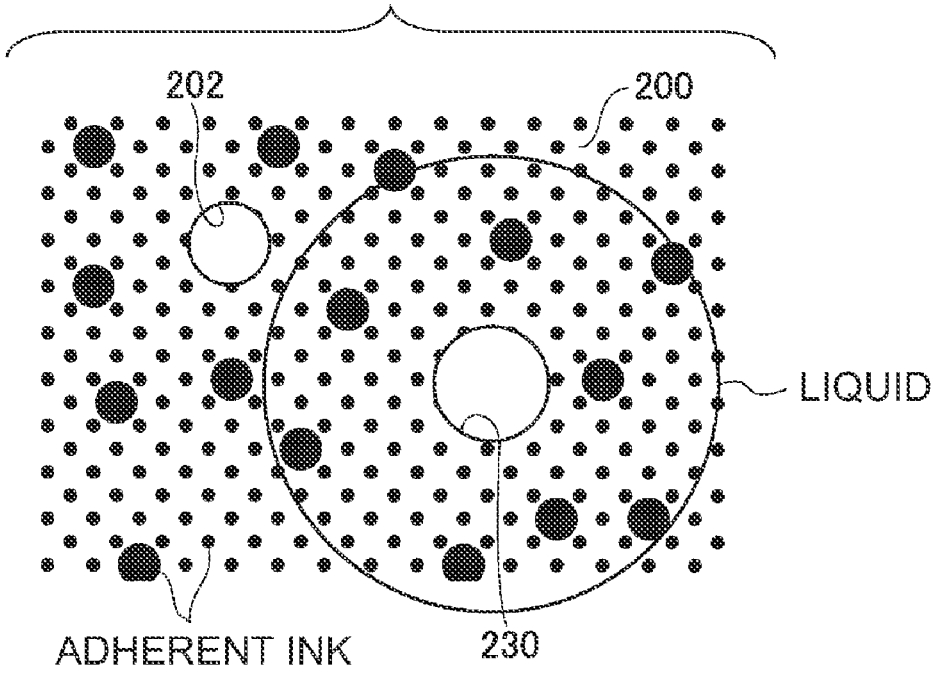
FIG. 5B is a plan view illustrating a state in which the liquid has been caused to overflow through the collecting hole by using the collecting device of the first exemplary embodiment.

As illustrated in FIG. 5B, the liquid overflowing from a collecting hole 230 spreads in radial directions centered on the collecting hole 230, joins up with adherent ink on the droplet ejecting face 200 by surface tension, and becomes integral therewith.

Figure 5C:
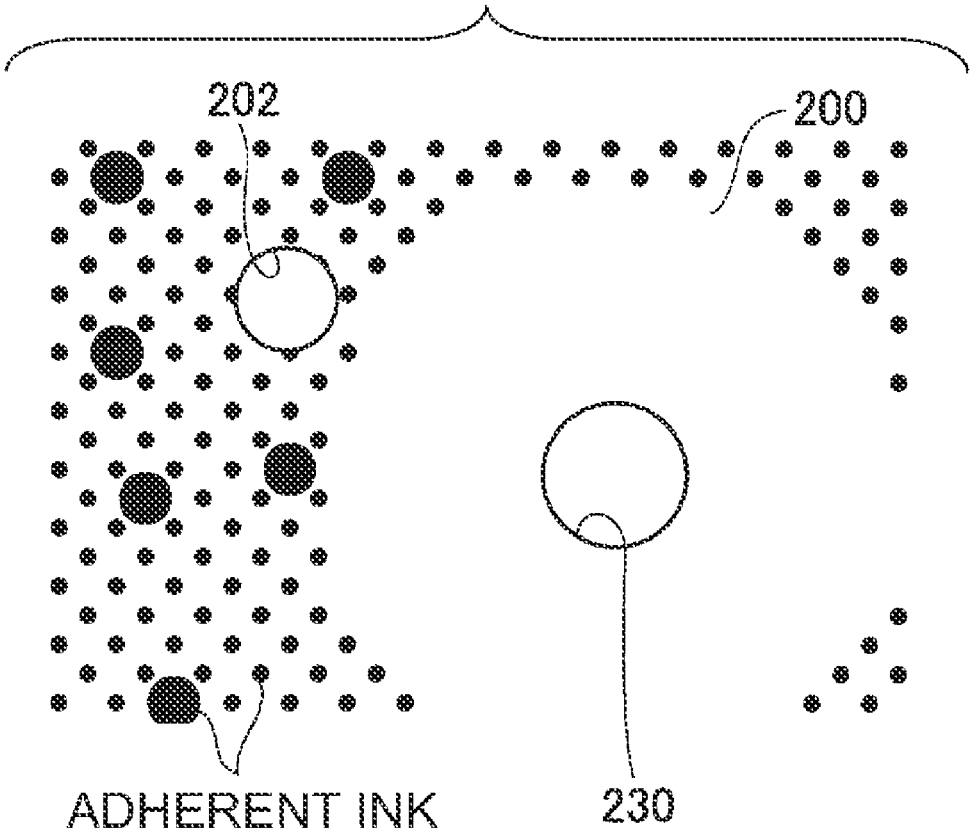
FIG. 5C is a plan view illustrating a state in which the overflowed liquid is collected through the collecting hole together with adherent liquid, using the collecting device of the first exemplary embodiment.

Then, the control section 300 sends a signal to collect the liquid to the syringe pump 254, as illustrated in FIG. 4. The syringe pump 254 receives the signal and lowers the pressure of the air layer G. As a result, negative pressure acts on the liquid in the collecting flow path 256, via the storage tank 252, and the liquid that overflowed at the droplet ejecting face 200 is collected toward the storage tank 252 along with the adherent ink with which the liquid has joined and become integral (see FIG. 5C). Subsequently, the control section 300 sends a closing signal to the valve 258.

In the above inkjet recording device 10, because the liquid is caused to overflow from the collecting holes 230 and the overflowed liquid and adherent ink are collected through the collecting holes 230 together, the adherent ink may be collected from a larger area of the droplet ejecting face 200 than in a case in which adherent ink is collected without liquid being caused to overflow from collecting holes. Further, adherent ink adhered to the droplet ejecting face 200 may be collected without interrupting recording operations, in contrast with an inkjet recording device in which a wiping operation is required for collecting adherent ink that is adhered to the droplet ejecting face 200. Thus, the inkjet recording device 10 relating to the present invention may maintain consistent image quality without losing productivity.

Because the pressure produced by the syringe pump 254 is transmitted to the liquid via the air layer G of the storage tank 252, pressures acting on the liquid may be finely adjusted more easily than when a pressure is directly transmitted to the liquid.

Because the collecting device 250 collects the adherent liquid together with the liquid, the liquid is mixed with the adherent liquid and viscosity thereof is raised, and it becomes less easier to overflow the liquid through the collecting holes 230. However, the control section 300 controls the syringe pump 254 and alters the pressure acting on the liquid in accordance with the degree of viscosity of the liquid. Consequently, the predetermined amount of the liquid may be caused to overflow onto the droplet ejecting face 200 at each time.

Moreover, because the liquid repellence film is formed over the whole area of the droplet ejecting face 200, the liquid overflowing from the collecting holes 230 and the adherent liquid joined therewith may be collected without leaving residues. Further, because the droplet ejecting face 200 is formed so as to be smooth over the whole area, the liquid overflowing from the collecting holes 230 spreads across the droplet ejecting face 200 substantially uniformly and adherent liquid within a predetermined range may be reliably collected.

In addition, even if the adherent ink rises in viscosity, because the liquid dissolves or disperses the adherent ink, the adherent ink may be reliably collected together with the liquid. Even if the liquid overflowing from the collecting hole 230 covers the nozzle 202 and the liquid is left behind in the nozzle 202 after the liquid has been collected, because the color of the liquid is the same color as the adherent liquid or is transparent, the color of the droplets ejected from the nozzles may be unchanged.

Figure 6A:
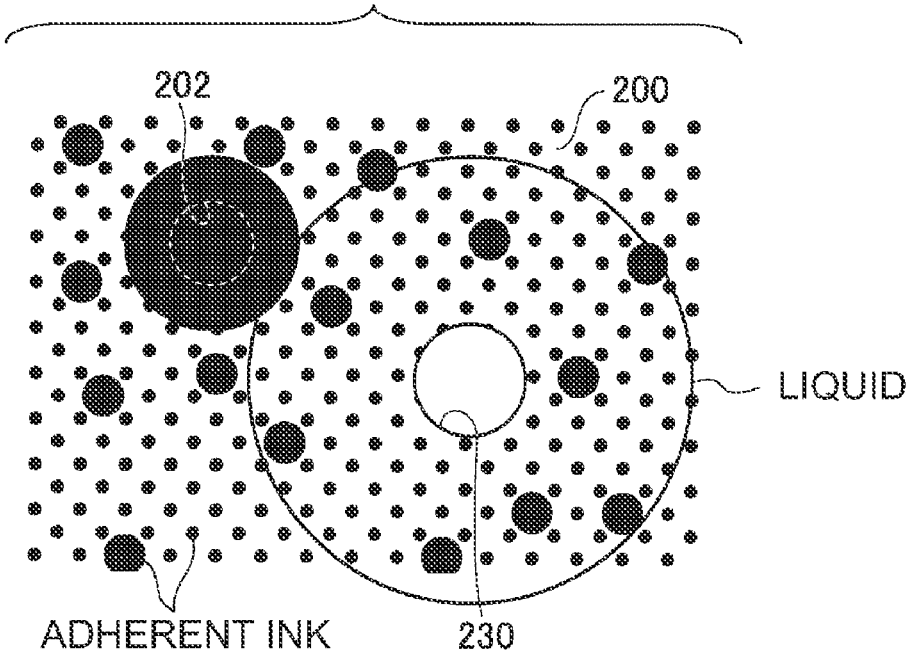
FIG. 6A is a plan view illustrating a state in which the liquid has been caused to overflow through the collecting hole by using the collecting device of the first exemplary embodiment.
Figure 6B:
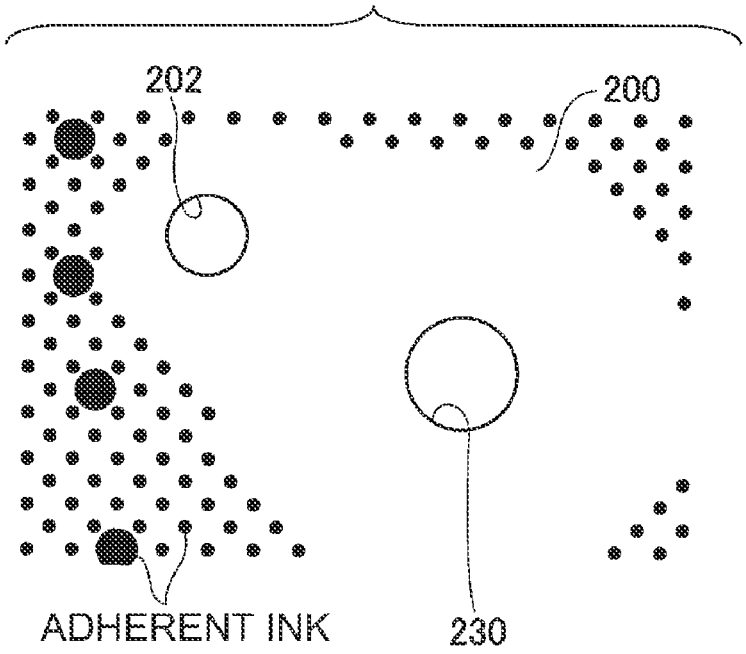
FIG. 6B is a plan view illustrating a state in which the overflowed liquid is collected through the collecting hole together with the adherent liquid by using the collecting device of the first exemplary embodiment.

In FIG. 6A, an effect of the collecting operation when adherent ink covers the nozzle 202 is described. Even though the adherent ink thus covers the nozzle 202, the liquid is caused to overflow from the collecting hole 230, the adherent ink and the collection ink are joined, and the liquid is collected through the collecting hole 230. Thus, the adherent ink covering the nozzle 202 is collected together with the liquid (see FIG. 6B).

In the collecting operation of the present exemplary embodiment, liquid collecting operations including causing the liquid to overflow onto the droplet ejecting face 200 and collecting both the overflowed liquid and the adherent liquid that has joined with the liquid are carried out. However, the present invention is not to be limited thus. An operation including applying negative pressure in the collecting holes 230 and collecting adherent ink adhering to the droplet ejecting face 200 may be carried out before the liquid is caused to overflow onto the droplet ejecting face 200. For example, if adherent ink has already covered a collecting hole 230 before the collecting operation, then when the liquid is caused to overflow from the collecting hole 230, liquid quantities around the collecting hole 230 may be excessively large and there is a risk of the liquid and adherent liquid spilling over from the droplet ejecting face 200. On the other hand, by applying a negative pressure to the collecting holes 230 before the liquid is caused to overflow through the collecting hole 230 to the droplet ejecting face 200 and then causing the liquid to overflow onto the droplet ejecting face 200, the predetermined quantity of the liquid may be overflowed onto the droplet ejecting face 200 at each time. Moreover, overspill of the liquid may be suppressed.

The present exemplary embodiment has a constitution that implements pressure adjustment by the syringe pump 254 via air in the storage tank 252. However, the present invention is not to be limited thus. A constitution in which pressure adjustment by the syringe pump 254 is implemented via the liquid in the storage tank 252 is possible.

Next, the operation of replacement of liquid, which is performed between the storage tank 252 and the collection tank 294, is described.

As illustrated in FIG. 3, the liquid supply channel 290 is connected to one side of an upper portion of the collection tank 294. A bi-directional pump 296 is provided on the liquid supply channel 290 between the collection tank 294 and the valve 292. The pump 296 can be switched between a flow of liquid toward the collection tank 294 (arrow X1) and a flow of liquid toward the storage tank 252 (arrow X2). Herein, the pump 296 is controlled by the control section 300. An atmosphere communication port 298, which is in communication with the atmosphere, is formed at another side of the upper portion of the collection tank 294.

Describing the replacement operation for this case, when the collecting operation has been implemented a predetermined number of times or the sensor that measures the degree of viscosity of the liquid (not illustrated) detected that the viscosity has reached a predetermined value, the control section 300 operates the pump 296 and sends liquid in the storage tank 252 and the collecting flow path 256 through the liquid supply channel 290 into the collection tank 294 that is empty.

When the liquid has been collected in the collection tank 294, the control section 300 outputs an indication reporting on an not-illustrated display that the collection is complete. Thereafter, a user removes the collection tank 294 in which the liquid has been collected and replaces the same with a new collection tank 294. When the collection tank 294 has been replaced, the control section 300 operates the pump 296 and supplies the new liquid in the collection tank 294 through the liquid supply channel 290 to the storage tank 252. Thus, the replacement of liquid between the storage tank 252 and the collection tank 294 is carried out.

In the present exemplary embodiment, the control section 300 opens the valve 258 at a time of the replacement operation, but the present invention is not to be limited thus. The valve 258 can be closed by the control section 300 at a time except collecting operations. By opening the storage tank 252 to the atmosphere, the liquid can be retrieved more efficiently than when the storage tank 252 is in a closed state. Therefore, for example, an atmosphere opening portion that can be closed (not illustrated) or the like may be provided at the upper portion of the storage tank 252.

Next, preferable arrangement patterns of the nozzles 202 and the collecting holes 230 are described.

In the first exemplary embodiment, the arrangement pattern of the nozzles 202 and the collecting holes 230 is the arrangement pattern illustrated in FIG. 15, but the present invention is not to be limited thus. Any of the arrangement patterns in FIG. 13, FIG. 14 and FIG. 16 to FIG. 19 are also possible.

Figure 13:
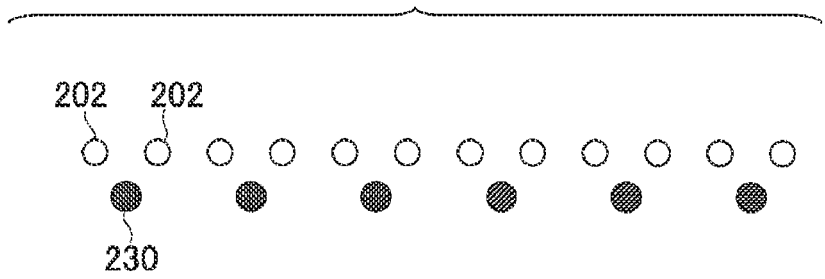
FIG. 13 is a plan view illustrating an arrangement of the nozzles and the collecting holes at the head of the first exemplary embodiment.
Figure 14:
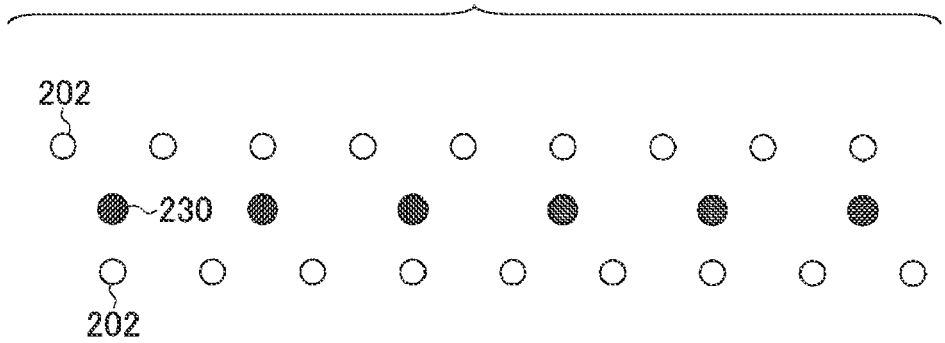
FIG. 14 is a plan view illustrating a variant example of the arrangement of the nozzles and the collecting holes at the head of the first exemplary embodiment.

FIG. 13 illustrates a preferable arrangement pattern of the collecting holes 230 when the nozzles 202 are arranged in one row, FIG. 14 illustrates a preferable arrangement pattern of the collecting holes 230 when the nozzles 202 are arranged in two rows and a spacing between the rows is less than 1400 μm, and FIG. 15 illustrates a preferable arrangement pattern of the collecting holes 230 when the nozzles 202 are arranged in two rows and the spacing between the two rows is 1400 μm or larger. This categorization of spacing of the nozzle rows and arrangements of the collecting holes 230 is because of the following reasons: the nozzles are ordinarily disposed to be separated by around 0.7 to 1 mm from a non-recording medium, and if the diameter of droplets that adhere to the droplet ejecting face 200 is 2000 μm or larger, there is a risk that the ink droplets will touch the non-recording medium and soil the non-recording medium, and thus, it is preferable to limit the area over which the liquid is overflowed into an area of a range of 1000 μm or less from each collecting hole 230. Taking account of increases in quantity due to the joining of the droplets of the liquid with adherent liquid adhered to the droplet ejecting face 200, it is preferable to perform control so as to cause the liquid overflow toward an area up to around 700 μm from each collecting hole 230. Therefore, if the spacing of the two rows of the nozzles 202 is 1400 μm or larger, it is preferable to form one row of the collecting holes 230 along each row of nozzles 202.

FIG. 16 to FIG. 19 illustrate excellent arrangement patterns of the collecting holes 230 when the nozzles 202 are arranged in matrix.

Figure 16:
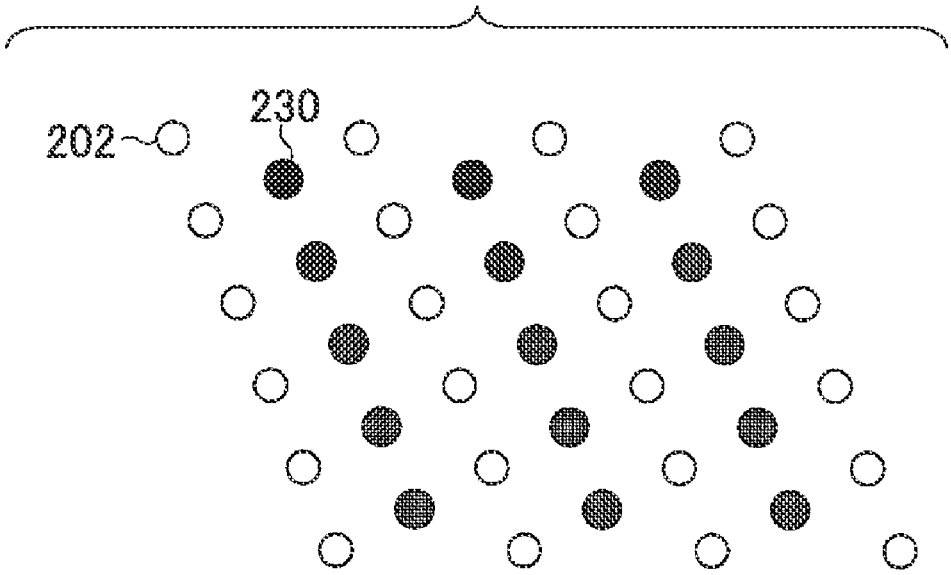
FIG. 16 is a plan view illustrating a variant example of the arrangement of the nozzles and the collecting holes at the head of the first exemplary embodiment.
Figure 17:
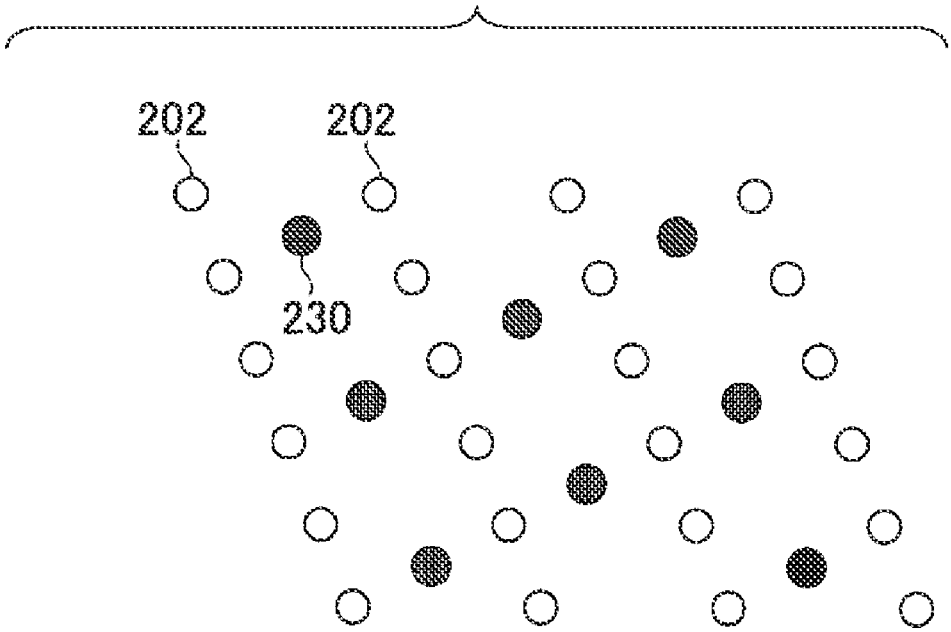
FIG. 17 is a plan view illustrating a variant example of the arrangement of the nozzles and the collecting holes at the head of the first exemplary embodiment.
Figure 18:
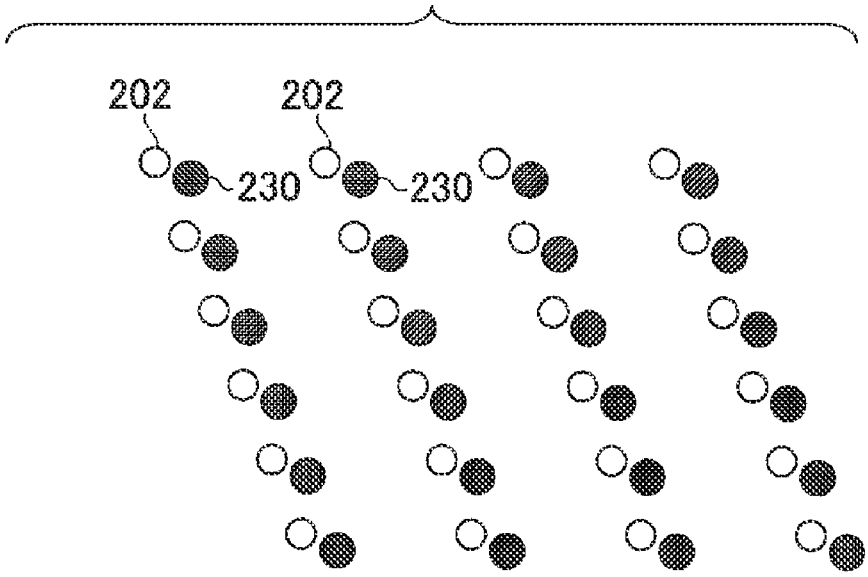
FIG. 18 is a plan view illustrating a variant example of the arrangement of the nozzles and the collecting holes at the head of the first exemplary embodiment.
Figure 19:
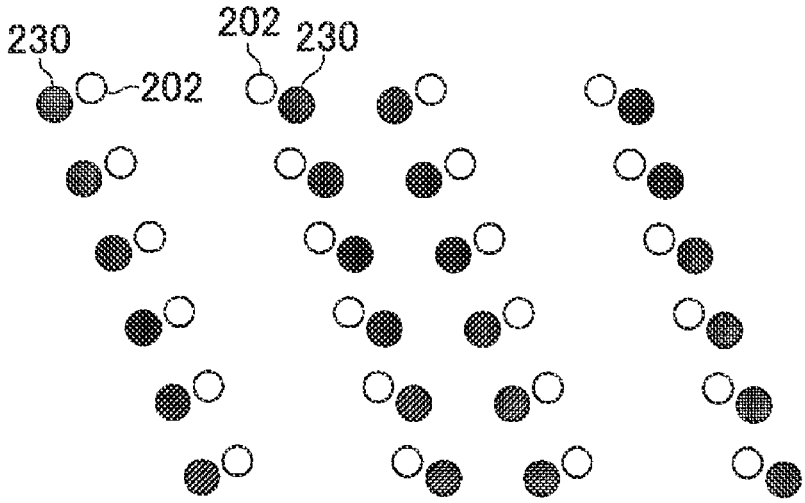
FIG. 19 is a plan view illustrating a variant example of the arrangement of the nozzles and the collecting holes at the head of the first exemplary embodiment.

In FIG. 16, one row of the collecting holes 230 is arranged in correspondence with one row of the nozzles 202. In FIG. 17, one row with a small number of the collecting holes 230 is arranged in correspondence with one row of the nozzles 202. In FIG. 18, one row of the collecting holes 230 is arranged very close to one row of the nozzles 202. In FIG. 19, individual rows of the collecting holes 230 are arranged so as to be at alternatingly opposite sides of rows of the nozzles 202.

Second Exemplary Embodiment

Next, an inkjet recording device of a second exemplary embodiment of the present invention is described. In the inkjet recording device of the second exemplary embodiment, the collecting device 250 of the inkjet recording device 10 of the first exemplary embodiment is replaced with a collecting device 310. Portions that are the same as in the first exemplary embodiment are assigned the same reference numerals and explanations thereof are omitted.

Figure 7:
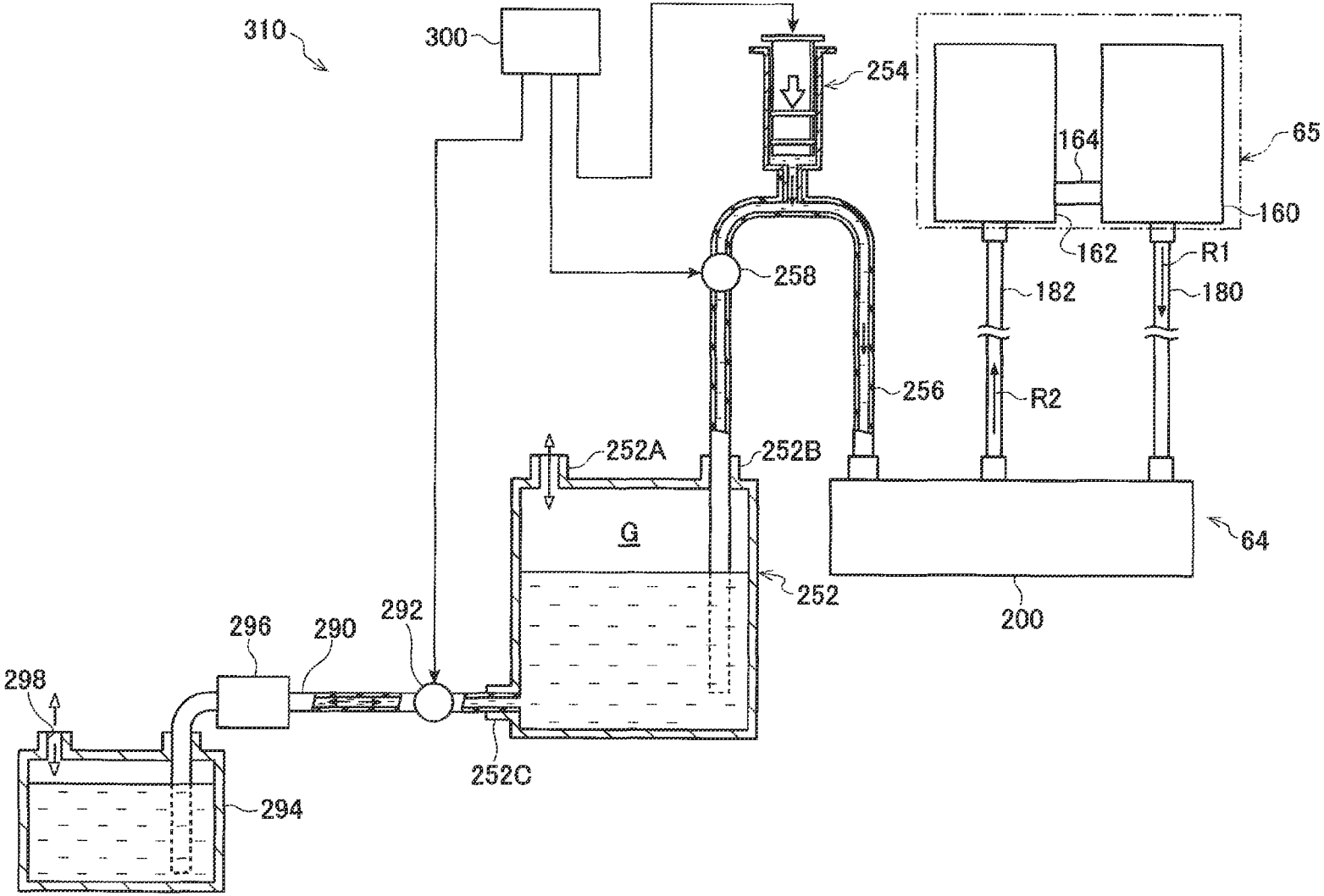
FIG. 7 is a schematic sectional side view illustrating a state in which liquid is supplied to a collecting hole by using a collecting device of a second exemplary embodiment.

As illustrated in FIG. 7, the collecting device 310 of the present exemplary embodiment is structured with the storage tank 252, the collecting flow path 256 that connects the storage tank 252 with the collecting holes 230, the syringe pump 254, which is disposed above the collecting flow path 256, the control section 300 that controls the syringe pump 254, the above-described collecting holes 230, and the valve 258, which is provided on the collecting flow path 256 at the storage tank 252 side relative to the syringe pump 254. Here too, the control section 300 and the syringe pump 254 are an example of the pressure increasing—decreasing unit of the present invention.

In the present exemplary embodiment, the syringe pump 254 is disposed above the collecting flow path 256 and the first connection port 252A of the storage tank 252 is opened to the atmosphere.

Further, in the present exemplary embodiment, the control section 300 closes the valve 258 when the liquid is to be overflowed from the collecting holes 230, that is, when positive pressure is to be applied to the liquid in the collecting flow path 256 by the syringe pump 254. The control section 300 opens the valve 258 when a negative pressure is to be applied to the liquid in the collecting flow path 256 by the syringe pump 254.

Next, operation of the inkjet recording device of the second exemplary embodiment is described.

As illustrated in FIG. 7, when the collecting operation is to be implemented in the collecting device 310, signals are sent from the control section 300 to respective sections. The valve 258 receives a signal and is closed, and the syringe pump 254 pressurizes the liquid in the collecting flow path 256 such that the predetermined amount of liquid is caused to overflow onto the droplet ejecting face 200. As a result, the liquid overflows from the collecting holes 230.

As being illustrated in FIG. 5B, the liquid overflowing from the collecting holes 230 spreads in radial directions centered on the collecting holes 230, joins up with adherent ink on the droplet ejecting face 200 by surface tension, and becomes integral therewith.

Figure 8:
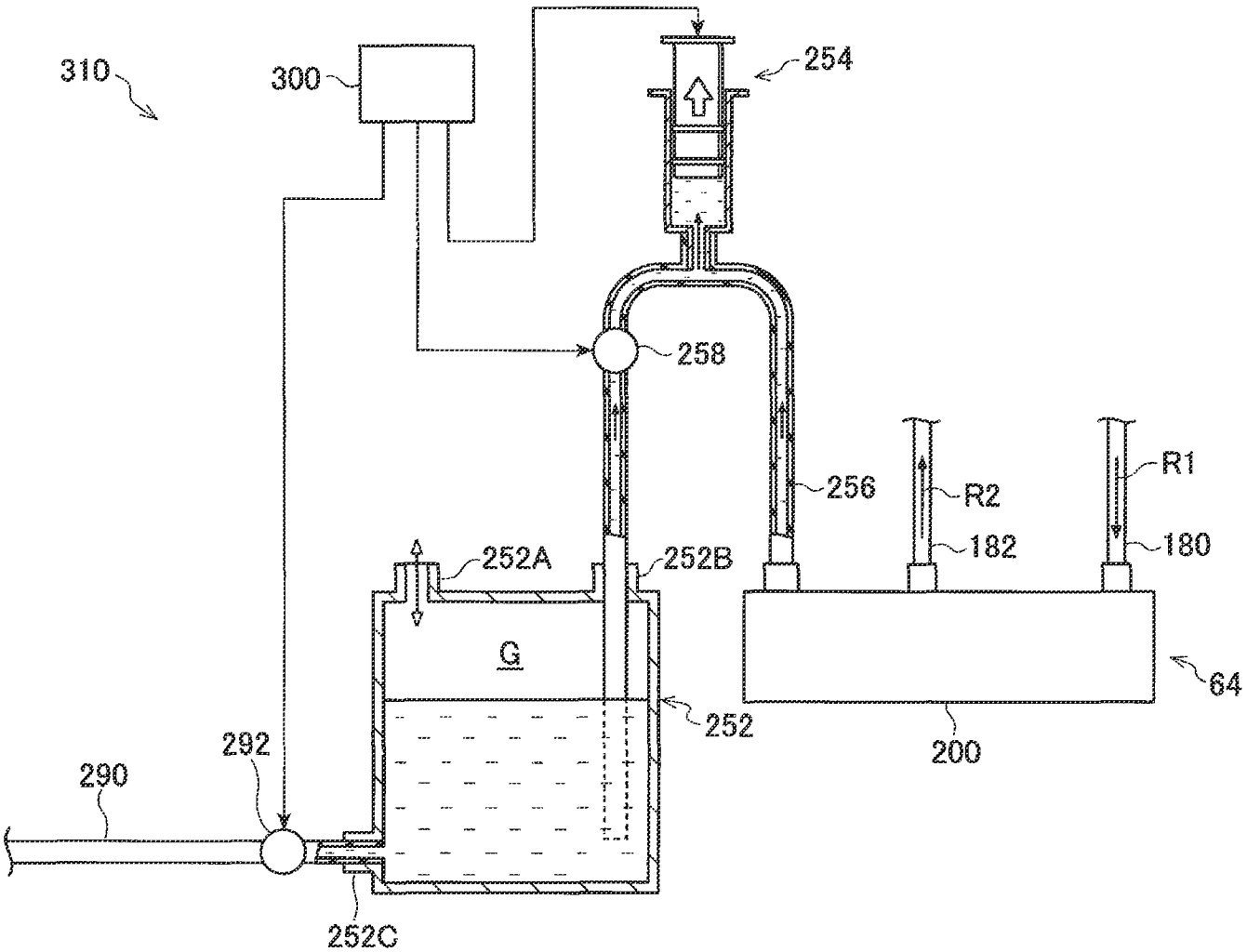
FIG. 8 is a schematic sectional side view illustrating a state in which the liquid is collected through the collecting hole by using the collecting device of the second exemplary embodiment.

Then, as illustrated in FIG. 8, the control section 300 sends a signal to collect the liquid to the syringe pump 254. The syringe pump 254 receives the signal and lowers the pressure of the liquid in the collecting flow path 256. As a result, negative pressure acts on the liquid in the collecting flow path 256, and the liquid that overflowed to the droplet ejecting face 200 is collected into the collecting flow path 256 along with the adherent ink with which the liquid has joined and become integral (see FIG. 5C). At this time, the liquid in the collecting flow path 256 and the storage tank is in a negative pressure state.

In the present exemplary embodiment described above, because the liquid is caused to overflow from the collecting holes 230 and the overflowed liquid and adherent ink are collected through the collecting holes 230 together, the adherent liquid may be collected from a larger area of the droplet ejecting face 200 than when adherent ink is collected without liquid being caused to overflow from collecting holes 230. Further, adherent liquid adhered to the droplet ejecting face 200 may be collected without interrupting recording operations, in contrast with an inkjet recording apparatus in which a wiping operation is required for collecting adherent ink adhered to a droplet ejecting face.

Further, because pressure is applied directly to the liquid in the collecting flow path 256 from the syringe pump 254, propagation of the pressure is faster than in an inkjet recording device having a constitution in which pressure is not applied directly.

Third Exemplary Embodiment

Next, an inkjet recording device of a third exemplary embodiment of the present invention is described. In the inkjet recording device of the third exemplary embodiment, the collecting device 250 of the inkjet recording device 10 of the first exemplary embodiment is replaced with a collecting device 320. Portions that are the same as in the first exemplary embodiment are assigned the same reference numerals and explanations thereof are omitted.

Figure 9:
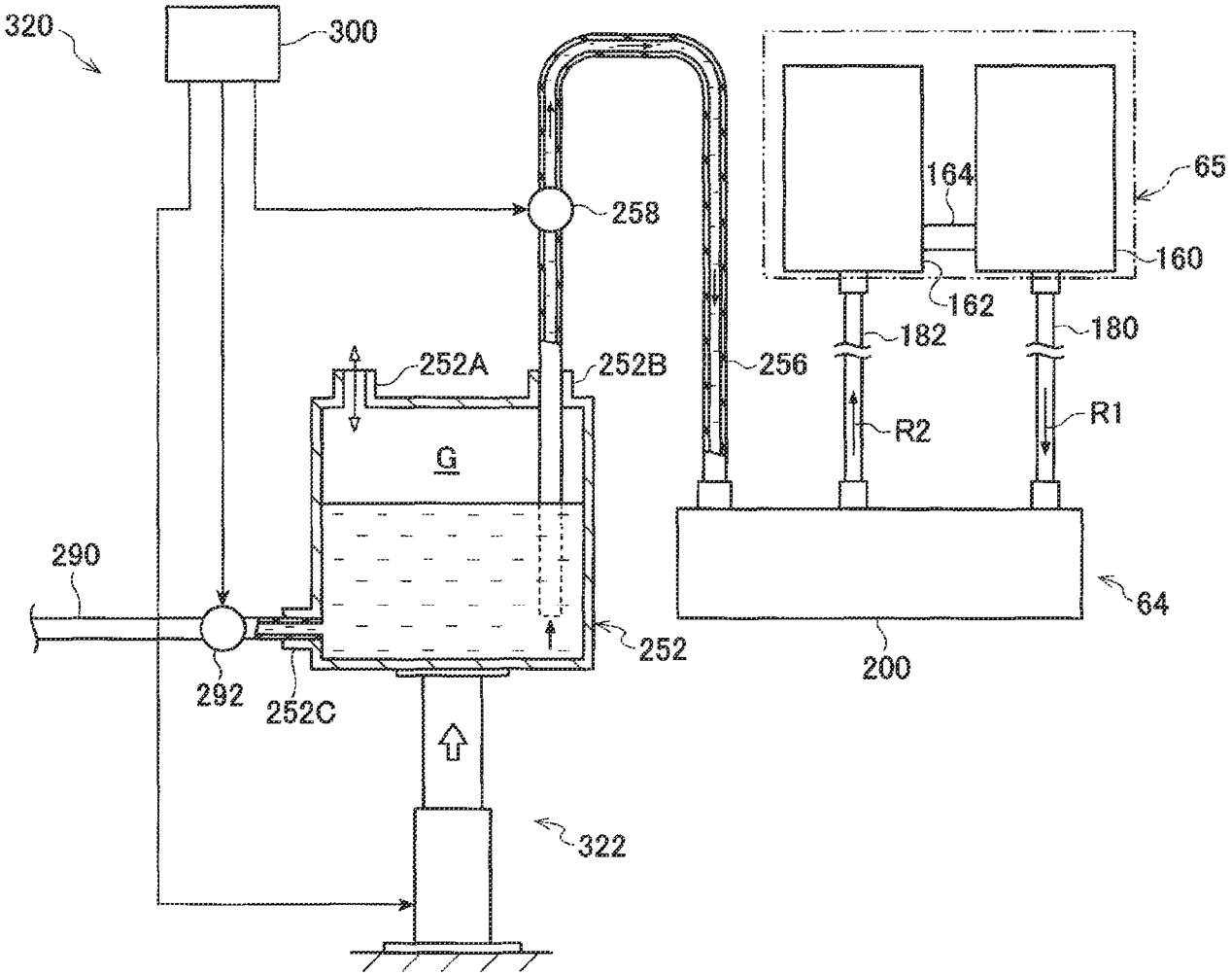
FIG. 9 is a schematic sectional side view illustrating a state in which liquid is supplied to a collecting hole by using a collecting device of a third exemplary embodiment.

As illustrated in FIG. 9, the collecting device 320 of the present exemplary embodiment is constituted of the storage tank 252, the collecting holes 230, the collecting flow path 256 that connects the storage tank 252 with the collecting holes 230, a raising-lowering apparatus 322 that is attached to a lower portion of the storage tank 252, and the control section 300, which controls the raising-lowering apparatus 322. Here, the control section 300 and the raising-lowering apparatus 322 are an example of the pressure increasing-decreasing unit of the present invention.

In the present exemplary embodiment, the first connection port 252A of the storage tank 252 is opened to the atmosphere. Further, in the present exemplary embodiment, the storage tank 252 can be moved upward or downward by the raising-lowering apparatus 322.

An air cylinder capable of controlling an extension amount at a rod side thereof (an extension side) can be employed as the raising-lowering apparatus 322 of the present exemplary embodiment employs However, the present invention is not to be limited to the above constitution. Providing that the extension amount at the rod side may be controlled, an oil cylinder may be used instead of an air cylinder. Further, a raising-lowering apparatus that is a combination of a motor and ball-screw or the like can be employed.

The valve 258 of the present exemplary embodiment is controlled by the control section 300 so as to close only during the liquid replacement operation.

Next, operation of the inkjet recording device of the third exemplary embodiment is described.

As illustrated in FIG. 9, when the collecting operation is to be implemented in the collecting device 320, signals are sent from the control section 300 to respective sections. The raising-lowering apparatus 322 raises the storage tank 252 such that the predetermined amount of liquid overflows onto the droplet ejecting face 200. To an extent that the position of the storage tank 252 is disposed higher than the head 64, pressure in the collecting flow path 256 rises and the liquid overflows from the collecting holes 230.

As being illustrated in FIG. 5B, the liquid overflowing from the collecting holes 230 spreads in radial directions centered on the collecting holes 230, joins up with adherent ink on the droplet ejecting face 200 by surface tension, and becomes integral therewith.

Figure 10:
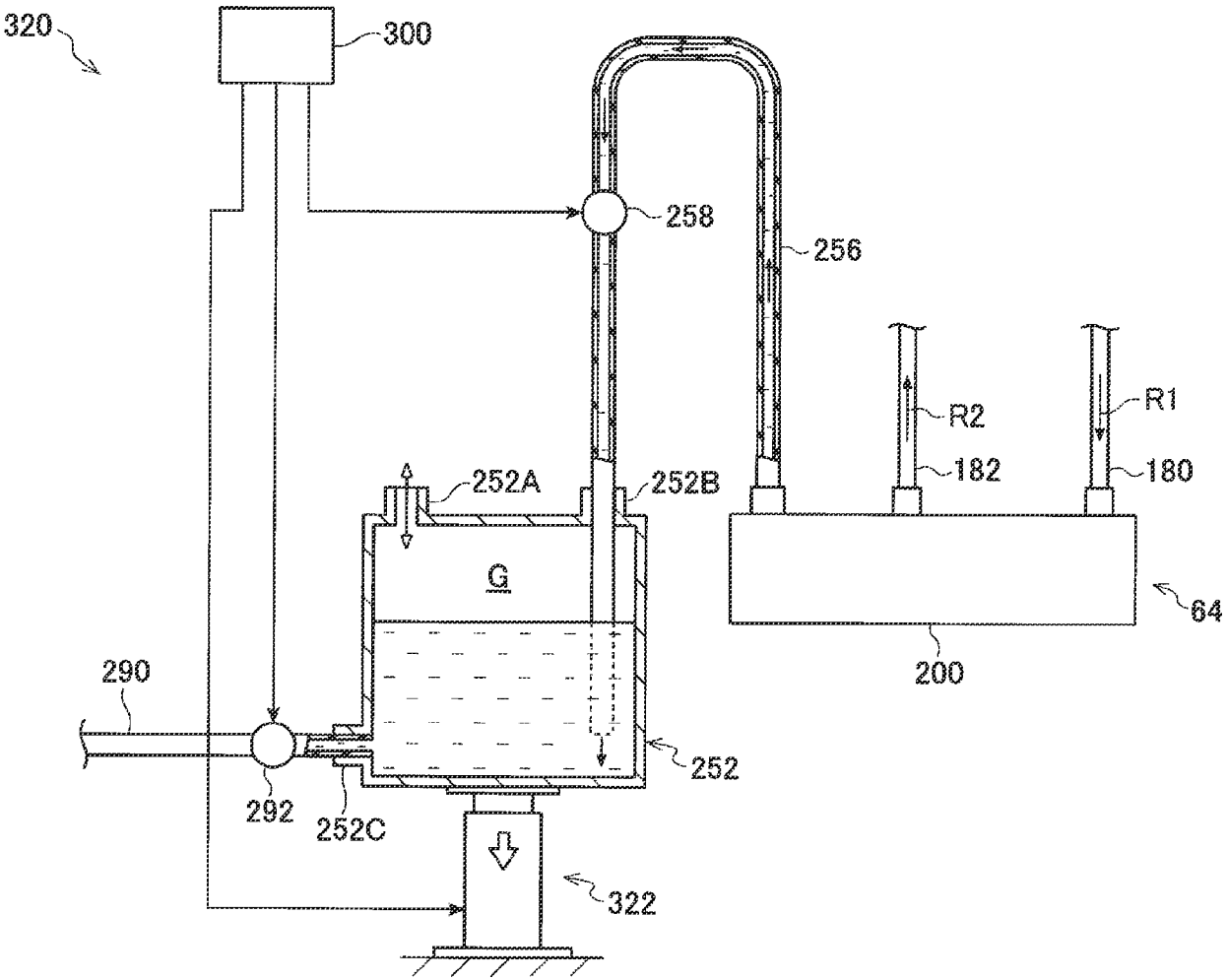
FIG. 10 is a schematic sectional side view illustrating a state in which the liquid is collected through the collecting hole by using the collecting device of the third exemplary embodiment.

Then, as illustrated in FIG. 10, the control section 300 sends a signal to collect the liquid to the raising-lowering apparatus 322. The raising-lowering apparatus 322 receives the signal and descends. As a result, the pressure of the liquid in the collecting flow path 256 decreases, negative pressure acts on the liquid in the collecting flow path 256, and the liquid that overflowed to the droplet ejecting face 200 is collected into the collecting flow path 256 along with the adherent ink with which the liquid has joined and become integral (see FIG. 5C).

In the present exemplary embodiment described above, because the liquid is caused to overflow from the collecting holes 230 and the overflowed liquid and adherent ink are collected through the collecting holes 230 together, the adherent liquid may be collected from a larger area of the droplet ejecting face 200 than in an inkjet recording apparatus in which adherent ink is collected without liquid being caused to overflow from collecting holes. Further, adherent liquid adhering to the droplet ejecting face 200 may be collected without interrupting recording operations, in contrast with an inkjet recording apparatus in which a wiping operation is required for collecting adherent ink adhered to a droplet ejecting face.

Further, because the amount of liquid overflowing from the collecting holes 230 may be adjusted by the pressure that acts on the liquid when the storage tank is raised or lowered by the raising-lowering apparatus 322, a device such as a syringe pump performing a precise control is not be required. Accordingly, an economic advantage can be expected.

Fourth Exemplary Embodiment

Next, an inkjet recording device of a fourth exemplary embodiment of the present invention is described. In the inkjet recording device of the fourth exemplary embodiment the collecting device 250 of the inkjet recording device 10 of the first exemplary embodiment is replaced with a collecting device 330. Portions that are the same as in the first exemplary embodiment are assigned the same reference numerals and explanations thereof are omitted.

Figure 11:
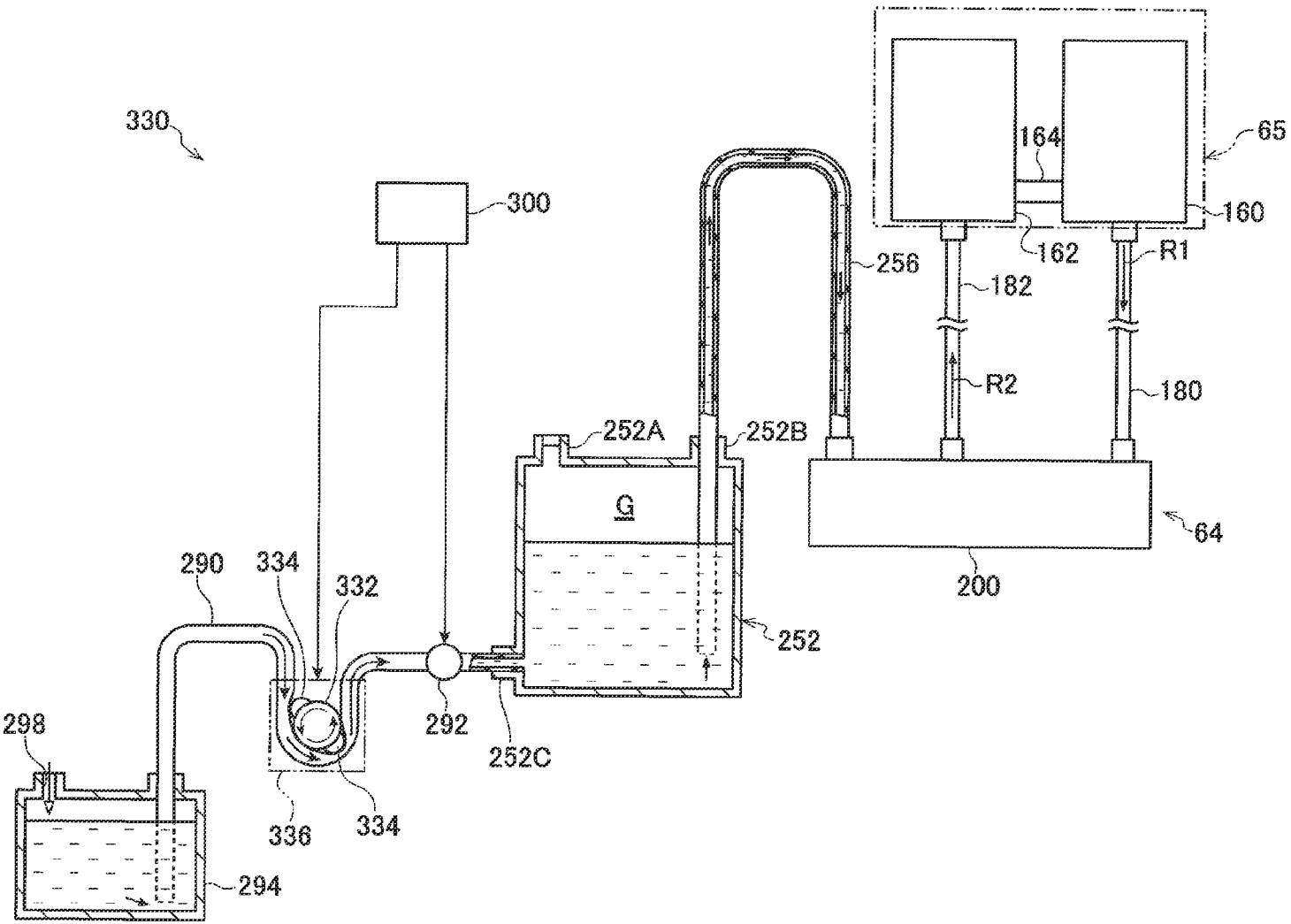
FIG. 11 is a schematic sectional side view illustrating a state in which liquid is supplied to a collecting hole by using a collecting device of a fourth exemplary embodiment.

As illustrated in FIG. 11, the collecting device 330 of the present exemplary embodiment is constituted of the storage tank 252, the collecting holes 230, the collecting flow path 256 that connects the storage tank 252 with the collecting holes 230, a tube pump 332 that is provided on the liquid supply channel 290 at the collection tank 294 side relative to the valve 292 and that causes the liquid supply channel 290 to deform, and the control section 300, which controls the tube pump 332 and the valve 292. Here, the control section 300 and the tube pump 332 are an example of the pressure increasing-decreasing unit of the present invention.

In the present exemplary embodiment, the valve 258 of the first exemplary embodiment is not provided on the collecting flow path 256, and the first connection port 252A of the storage tank 252 is closed. Therefore, the storage tank 252 is in a substantially closed state.

As illustrated in FIG. 11, the tube pump 332 is provided such that a portion of the liquid supply channel 290 is wound therearound. The tube pump 332 is provided with rollers 334, and turns with a motor controlled by the control section 300 as a drive source. The liquid supply channel 290 is squeezed by the rollers 334 while the tube pump 332 is turning. Thus, a unidirectional flow is produced in the liquid in the liquid supply channel 290. In the present exemplary embodiment, because the tube pump 332 is provided between the valve 258 and the collection tank 294, there is no need to provide the pump 296.

The valve 292 of the present exemplary embodiment is controlled by the control section 300 so as to open when the collecting device 330 is implementing the collecting operation and close at the other time.

Next, operation of the inkjet recording device of the fourth exemplary embodiment is described.

As illustrated in FIG. 11, when the collecting operation is to be implemented in the collecting device 330, signals are sent from the control section 300 to respective sections. The tube pump 332 turns forward while squeezing the liquid supply channel 290 and generates a flow towards the collecting holes 230, such that the predetermined amount of the liquid overflows onto the droplet ejecting face 200. At this time, the flow of liquid caused by the tube pump 332 is transmitted to the collecting flow path 256 via the storage tank 252. Therefore, pressure variations caused by the tube pump 332 (pulsing) or the like are suppressed. In the present exemplary embodiment, the amount of liquid that overflow from the droplet ejecting face 200 due to the pressure applied by the tube pump 332 may be determined by a beforehand testing.

As being illustrated in FIG. 5B, the liquid overflowing from the collecting holes 230 spreads in radial directions centered on the collecting holes 230, joins up with adherent ink on the droplet ejecting face 200 by surface tension, and becomes integral therewith.

Figure 12:
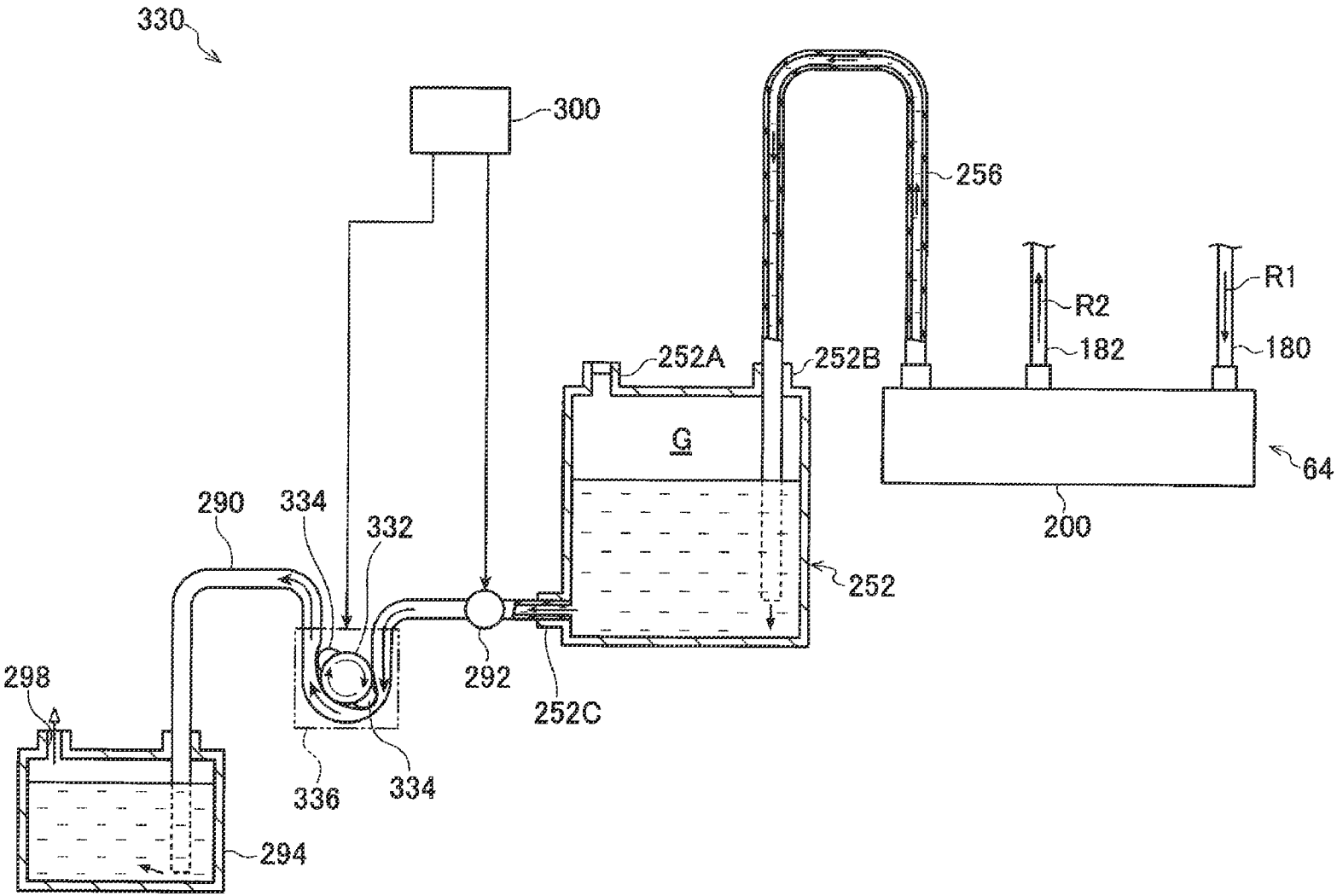
FIG. 12 is a schematic sectional side view illustrating a state in which the liquid is collected through the collecting hole by using the collecting device of the fourth exemplary embodiment.

Then, as illustrated in FIG. 12, the control section 300 sends a signal to collect the liquid to the tube pump 332. The tube pump 332 receives the signal and starts to turn backward while squeezing the liquid supply channel 290. As a result, the pressure of the liquid in the collecting flow path 256 decreases, negative pressure acts on the liquid in the collecting flow path 256, and the liquid that overflowed at the droplet ejecting face 200 is collected into the collecting flow path 256 along with the adherent ink with which the liquid has joined and become integral (see FIG. 5C).

In the present exemplary embodiment described above, because the liquid is caused to overflow from the collecting holes 230 and the overflowed liquid and adherent ink are collected through the collecting holes 230 together, the adherent liquid may be collected from a larger area of the droplet ejecting face 200 than in an inkjet recording device in which adherent ink is collected without liquid being caused to overflow from collecting holes. Further, adherent liquid adhering to the droplet ejecting face 200 may be collected without interrupting recording operations, in contrast with an inkjet recording device in which a wiping operation is required for collecting adherent ink that has adhered to a droplet ejecting face.

Further, because the amount of liquid overflowing from the collecting holes 230 may be adjusted by the pressure that acts on the liquid when the liquid supply channel 290 is squeezed by the tube pump 332, a device such as a syringe pump performing precise control is not required. Accordingly, an economic advantage can be expected.

The exemplary embodiments described above have a constitution using the ink circulation system 65 as an ink supply section, but the present invention is not to be limited to the above constitution and a constitution in which the ink is not circulated can be adopted. An embodiment in which the ink is not circulated include, for example, an embodiment having a constitution in which the ink is just supplied by using the ink supply section 160, the supply channel 180 and the common supply flow path 222.

Further, although in the exemplary embodiments described above, a recording head of an inkjet recording apparatus that ejects ink has been exemplified, embodiments of the present invention are not limited in the above exemplary embodiments. For example, the present invention can be applied to a droplet ejection devices that are intended for various industrial applications, such as ejecting colored inks onto polymer films to fabricate color filters for displays, ejecting organic electroluminescent solutions onto substrates to form electroluminescent display panels, ejecting solutions and performing etching processes when fabricating printed circuit boards or the like.

Further, the above exemplary embodiments are not to limit the inventions recited in the claims, and not all of the combinations of characteristics described in the above exemplary embodiments are necessarily required for a resolution of the invention. Inventions with various stages of the exemplary embodiments are to be included, and various inventions may be derived by combinations of the disclosed pluralities of structural elements in accordance with circumstances. Even if some structural element is removed from the totality of elements illustrated in the exemplary embodiments, as long as the effects are obtained, a constitution from which some of the element has been removed may be derived to serve as the invention.

According to the first aspect of the present invention, a liquid is overflowed onto a droplet ejecting face through a collecting hole by a collecting unit. The overflowed liquid joins with adherent liquid around the collecting hole by surface tension, and is thereafter collected through the collecting hole together with the adherent liquid by the collecting unit. Thus, adherent liquid that has adhered to the droplet ejecting face is collected through the collecting hole.

Because the liquid is caused to overflow from the collecting hole and the overflowed liquid and adherent ink are collected through the collecting hole together, the adherent liquid may be collected from a larger area of the droplet ejecting face than in an inkjet recording device in which adherent ink is collected without liquid being caused to overflow from a collecting hole.

Further, adherent liquid that has adhered to the droplet ejecting face may be collected without interrupting droplet ejection operations, in contrast with a case in which a wiping operation is required for collecting adherent ink that has adhered to a droplet ejecting face.

According to a second aspect of the present invention, the liquid is caused to overflow onto the droplet ejecting face through the collecting hole, the overflowed liquid joins with adherent liquid around the collecting hole by surface tension, and is thereafter collected through the collecting hole together with the adherent liquid.

Because the liquid is caused to overflow from the collecting hole and the overflowed liquid and adherent liquid are collected through the collecting hole together, the adherent liquid may be collected from a larger area of the droplet ejecting face than in a method in which adherent ink is collected without any liquid being caused to overflow from a collecting hole.

Further, adherent liquid that has adhered to the droplet ejecting face may be collected without interrupting droplet ejection operations, in contrast with a method including a wiping operation for collecting adherent ink adhering to a droplet ejecting face.

A third aspect of the present invention is the droplet ejection device in which the collecting unit includes: a liquid storage section that stores the liquid; a collecting flow path that communicates between the liquid storage section and the collecting hole; and a pressure increasing-decreasing unit that causes a pressure to act on the liquid stored in the liquid storage section to increase or decrease.

According to the third aspect, pressure is applied to the liquid stored in the liquid storage section by the pressure increasing-decreasing unit. When the pressure acting on the liquid stored in the liquid storage section increases, the liquid is overflowed through the collecting flow path and from the collecting hole, and when the pressure acting on the liquid stored in the liquid storage section decreases, the overflowed liquid is collected (sucked) through the collecting flow path from the collecting hole to the liquid storage section. Because the pressure increasing-decreasing unit thus causes pressure to act on the liquid stored in the liquid storage section, it is easy to finely regulate the pressure acting on the liquid.

A fourth aspect of the present invention is the droplet ejection device in which the collecting unit includes: a liquid storage section that stores the liquid; a collecting flow path that communicates between the liquid storage section and the collecting hole; and a pressure increasing-decreasing unit that causes a pressure acting on the liquid in the collecting flow path to increase or decrease.

According to the fourth aspect, pressure is applied to the liquid in the collecting flow path by the pressure increasing-decreasing unit. When the pressure acting on the liquid in the collecting flow path increases, the liquid is overflowed from the collecting hole, and when the pressure acting on the liquid in the collecting flow path decreases, the overflowed liquid is collected (sucked) through the collecting hole. Because the pressure increasing-decreasing unit thus causes pressure to act on the liquid in the collecting flow path, propagation of the pressure to the liquid is improved.

A fifth aspect of the present invention is the droplet ejection device in which the pressure increasing-decreasing unit alters the pressure that is caused to act on the liquid in accordance with a degree of viscosity of the liquid.

Because the adherent liquid is collected together with the liquid, the liquid is mixed with the adherent liquid and viscosity is raised, and the liquid is less easily overflowed through the collecting hole. However, according to the fifth aspect, the pressure increasing-decreasing unit alters the pressure acting on the liquid in accordance with the degree of viscosity of the liquid. Therefore, a predetermined amount of the liquid may be caused to overflow onto the droplet ejecting face at each time.

A sixth aspect of the present invention is the droplet ejection device in which the pressure increasing-decreasing unit causes negative pressure to act on the collecting hole before the liquid is caused to overflow through the collecting hole to the droplet ejecting face.

If adherent liquid is covering the collecting hole, then when the liquid is caused to overflow from the collecting hole, liquid quantities around the collecting hole may become excessively large and there is a risk of the liquid and adherent liquid spilling over from the droplet ejecting face. However, according to the sixth aspect, by causing negative pressure to act on the collecting hole and collecting the adherent liquid that covers the collecting hole before the liquid is caused to overflow from the collecting hole onto the droplet ejecting face, a predetermined quantity of the liquid may be caused to overflow onto the droplet ejecting face at each time.

A seventh aspect of the present invention is the droplet ejection device in which a liquid repellence film is formed at the droplet ejecting face over a whole area thereof.

According to the seventh aspect, because the liquid repellence film is formed across the whole area of the droplet ejecting face, the liquid overflowed from the collecting hole and the adherent liquid joined therewith may be collected more effectively.

An eighth aspect of the present invention is the droplet ejection device in which the droplet ejecting face is formed to be flat over a whole area thereof.

According to the eighth aspect, because the droplet ejecting face is formed to be flat across the whole area, the liquid overflowing from the collecting hole spreads across the droplet ejecting face substantially uniformly and adherent liquid within a predetermined range may be reliably collected.

A ninth aspect of the present invention is the droplet ejection device in which the liquid is a liquid that dissolves or disperses the adherent liquid.

According to the ninth aspect, even if the adherent ink rises in viscosity, because the liquid dissolves or disperses the adherent liquid, the adherent liquid may be reliably collected together with the liquid.

A tenth aspect of the present invention is the droplet ejection device in which a color of the liquid is the same color as the adherent liquid or transparent.

According to the tenth aspect, even if the liquid overflowing from the collecting hole covers the ejecting aperture and liquid is left behind after the liquid has been collected, because the color of the liquid is the same color as the adherent liquid or is transparent, the color of droplets ejected from the ejecting aperture may be unchanged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A droplet ejection device comprising:

a droplet ejecting head comprising a droplet ejecting surface on which an ejecting aperture from which droplets are ejected and a collecting hole for collecting adherent liquid adhered to the droplet ejecting surface are formed; and a collecting unit that causes the liquid to overflow to the droplet ejecting surface through the collecting hole and collects the overflowed liquid through the collecting hole together with the adherent liquid.

2. The droplet ejection device according to claim 1, wherein the collecting unit comprises:

a liquid storage section that stores the liquid;

a collecting flow path that communicates between the liquid storage section and the collecting hole; and a pressure increasing-decreasing unit that causes a pressure to act on the liquid stored in the liquid storage section to increase or decrease.

3. The droplet ejection device according to claim 2, wherein the pressure increasing-decreasing unit alters the pressure that is caused to act on the liquid in accordance with a degree of viscosity of the liquid.

4. The droplet ejection device according to claim 3, wherein the pressure increasing-decreasing unit causes negative pressure to act on the collecting hole before the liquid is caused to overflow through the collecting hole to the droplet ejecting surface.

5. The droplet ejection device according to claim 2, wherein the pressure increasing-decreasing unit causes negative pressure to act on the collecting hole before the liquid is caused to overflow through the collecting hole to the droplet ejecting surface.

6. The droplet ejection device according to claim 1, wherein the collecting unit comprises:

a liquid storage section that stores the liquid;

a collecting flow path that communicates between the liquid storage section and the collecting hole; and a pressure increasing-decreasing unit that causes a pressure to act on the liquid in the collecting flow path to increase or decrease.

7. The droplet ejection device according to claim 6, wherein the pressure increasing-decreasing unit alters the pressure that is caused to act on the liquid in accordance with a degree of viscosity of the liquid.

8. The droplet ejection device according to claim 7, wherein the pressure increasing-decreasing unit causes negative pressure to act on the collecting hole before the liquid is caused to overflow through the collecting hole to the droplet ejecting surface.

9. The droplet ejection device according to claim 6, wherein the pressure increasing-decreasing unit causes negative pressure to act on the collecting hole before the liquid is caused to overflow through the collecting hole to the droplet ejecting surface.

10. The droplet ejection device according to claim 1, wherein a liquid repellence film is formed at the droplet ejecting surface over a whole area thereof.

11. The droplet ejection device according to claim 1, whereon the droplet ejecting surface is formed to be flat over a whole area thereof.

12. The droplet ejection device according to claim 1, wherein the liquid comprises a liquid that at least one of dissolves and disperses the adherent liquid.

13. The droplet ejection device according to claim 1, wherein a color of the liquid is the same color as the adherent liquid or transparent.

14. A method for collecting adherent liquid adhered to a droplet ejecting surface of a droplet ejecting head, the method comprising:

forming a collecting hole for collecting adherent liquid adhered to the droplet ejecting surface of a droplet ejecting head;

causing a liquid to overflow to the droplet ejecting surface through a collecting hole provided on the droplet ejecting surface, in which an ejecting aperture that ejects droplets is provided; and collecting the overflowed liquid through the collecting hole together with the adherent liquid adhered to the droplet ejecting surface.

* * * * *